US009315967B2

(12) United States Patent
Taylor et al.

(10) Patent No.: US 9,315,967 B2
(45) **Date of Patent: *Apr. 19, 2016**

(54) SWING AUTOMATION FOR ROPE SHOVEL

(71) Applicant: Harnischfeger Technologies, Inc., Wilmington, DE (US)

(72) Inventors: Wesley P. Taylor, Glendale, WI (US); Michael J. Linstroth, Port Washington, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/321,511

(22) Filed: Jul. 1, 2014

(65) Prior Publication Data

US 2014/0365082 A1 Dec. 11, 2014

Related U.S. Application Data

(63) Continuation of application No. 13/446,817, filed on Apr. 13, 2012, now Pat. No. 8,768,579.

(60) Provisional application No. 61/475,474, filed on Apr. 14, 2011.

(51) Int. Cl.
*E02F 3/43* (2006.01)
*E02F 9/20* (2006.01)
(Continued)

(52) U.S. Cl.
CPC . *E02F 3/437* (2013.01); *E02F 3/54* (2013.01); *E02F 7/026* (2013.01); *E02F 7/04* (2013.01); *E02F 7/06* (2013.01); *E02F 9/2033* (2013.01); *E02F 9/2045* (2013.01)

(58) Field of Classification Search
CPC ..... E02F 3/437; E02F 3/54; E02F 7/026; E02F 7/04; E02F 7/06; E02F 9/2033; E02F 9/2045
USPC ..... 701/50; 414/694
See application file for complete search history.

(56) References Cited

U.S. PATENT DOCUMENTS 3,207,339 A 9/1965 Neslin
3,648,029 A 3/1972 Ungnadner
(Continued)

FOREIGN PATENT DOCUMENTS

CA 215375 1/1922
CN 101614024 12/2009
(Continued)

OTHER PUBLICATIONS

First Office Action from the State Intellectual Property Office of the People's Republic of China for Application No. 201210188889.1 dated Jun. 26, 2015 (19 pages).
(Continued)

*Primary Examiner* — Yonel Beaulieu
*Assistant Examiner* — Angelina Shudy
(74) *Attorney, Agent, or Firm* — Michael Best & Friedrich LLP

(57) ABSTRACT

A system and method for various levels of automation of a swing-to-hopper motion for a rope shovel. An operator controls a rope shovel during a dig operation to load a dipper with materials. A controller receives position data, either via operator input or sensor data, for the dipper and a hopper where the materials are to be dumped. The controller then calculates an ideal path for the dipper to travel to be positioned above the hopper to dump the contents of the dipper. In some embodiments, the controller outputs operator feedback to assist the operator in traveling along the ideal path to the hopper. In some embodiments, the controller restricts the dipper motion such that the operator is not able to deviate beyond certain limits of the ideal path. In some embodiments, the controller automatically controls the movement of the dipper to reach the hopper.

22 Claims, 22 Drawing Sheets

(51) Int. Cl.

| | |
|---|---|
| ***E02F 3/54*** | (2006.01) |
| ***E02F 7/02*** | (2006.01) |
| ***E02F 7/04*** | (2006.01) |
| ***E02F 7/06*** | (2006.01) |

(56) References Cited

U.S. PATENT DOCUMENTS

| | | | | |
|---|---|---|---|---|
| 3,856,161 | A | 12/1974 | Baron | |
| 4,104,518 | A | 8/1978 | Schachinger et al. | |
| 4,268,214 | A | 5/1981 | Zeldman | |
| 4,398,851 | A | 8/1983 | Geuns et al. | |
| 5,404,661 | A | 4/1995 | Sahm et al. | |
| 5,408,767 | A | 4/1995 | Hazama et al. | |
| 5,493,798 | A | 2/1996 | Rocke et al. | |
| 5,528,498 | A | 6/1996 | Scholl | |
| 5,548,516 | A | 8/1996 | Gudat et al. | |
| 5,601,393 | A | 2/1997 | Waldschmitt | |
| 5,717,628 | A | 2/1998 | Hammerl et al. | |
| 5,908,458 | A | 6/1999 | Rowe et al. | |
| 5,937,292 | A | 8/1999 | Hammerl et al. | |
| 5,953,977 | A | 9/1999 | Krishna et al. | |
| 5,978,504 | A | 11/1999 | Leger | |
| 6,025,686 | A | 2/2000 | Wickert et al. | |
| 6,058,344 | A | 5/2000 | Rowe et al. | |
| 6,076,030 | A | 6/2000 | Rowe | |
| 6,085,583 | A | 7/2000 | Cannon et al. | |
| 6,108,949 | A | 8/2000 | Singh et al. | |
| 6,167,336 | A | 12/2000 | Singh et al. | |
| 6,223,110 | B1 | 4/2001 | Rowe et al. | |
| 6,247,538 | B1 | 6/2001 | Takeda et al. | |
| 6,272,413 | B1 | 8/2001 | Takahashi et al. | |
| 6,363,173 | B1 | 3/2002 | Stentz et al. | |
| 6,363,632 | B1 | 4/2002 | Stentz et al. | |
| 6,466,850 | B1 | 10/2002 | Hilgart | |
| 6,885,930 | B2 | 4/2005 | Wang | |
| 7,034,476 | B2 | 4/2006 | Wang et al. | |
| 7,126,299 | B2 | 10/2006 | Jackson | |
| 7,181,370 | B2 | 2/2007 | Furem et al. | |
| 7,227,273 | B2 | 6/2007 | Ahmad et al. | |
| 7,307,399 | B2 | 12/2007 | Furem | |
| 7,308,352 | B2 | 12/2007 | Wang et al. | |
| 7,375,490 | B2 | 5/2008 | Furem | |
| 7,385,372 | B2 | 6/2008 | Ahmad et al. | |
| 7,398,012 | B2 | 7/2008 | Koellner | |
| 7,406,399 | B2 | 7/2008 | Furem et al. | |
| 7,479,757 | B2 | 1/2009 | Ahmad | |
| 7,574,821 | B2 | 8/2009 | Furem | |
| 7,578,079 | B2 | 8/2009 | Furem | |
| 7,622,884 | B2 | 11/2009 | Furem | |
| 7,751,927 | B2 | 7/2010 | Pulli et al. | |
| 7,832,126 | B2 | 11/2010 | Koellner et al. | |
| 8,768,579 | B2 * | 7/2014 | Taylor | E02F 3/437 414/694 |
| 9,045,883 | B2 | 6/2015 | Schob et al. | |
| 2007/0150149 | A1 | 6/2007 | Peterson et al. | |
| 2007/0240341 | A1 | 10/2007 | Hyde | |
| 2008/0201108 | A1 | 8/2008 | Furem et al. | |
| 2008/0212344 | A1 | 9/2008 | Furem | |
| 2008/0282583 | A1 | 11/2008 | Koellner et al. | |
| 2009/0229101 | A1 | 9/2009 | Ahmad et al. | |
| 2010/0010714 | A1 | 1/2010 | Claxton | |
| 2010/0036645 | A1 | 2/2010 | McAree | |
| 2010/0076612 | A1 | 3/2010 | Robertson | |
| 2010/0185416 | A1 | 7/2010 | Furem et al. | |
| 2010/0223008 | A1 | 9/2010 | Dunbabin et al. | |
| 2010/0243593 | A1 * | 9/2010 | King | B66C 13/46 212/276 |
| 2011/0301817 | A1 | 12/2011 | Hobenshield et al. | |
| 2012/0101693 | A1 | 4/2012 | Taylor | |
| 2012/0277961 | A1 | 11/2012 | Colwell et al. | |
| 2013/0051963 | A1 | 2/2013 | Taylor | |
| 2013/0066527 | A1 | 3/2013 | Mizuochi et al. | |
| 2013/0096782 | A1 | 4/2013 | Good et al. | |
| 2013/0261904 | A1 | 10/2013 | Linstroth et al. | |
| 2013/0317709 | A1 | 11/2013 | Colwell et al. | |
| 2014/0025265 | A1 | 1/2014 | Taylor | |

FOREIGN PATENT DOCUMENTS

| | | | |
|---|---|---|---|
| DE | 19856610 | A1 | 6/1999 |
| EP | 0003287 | A1 | 8/1979 |
| EP | 0003287 | B1 | 3/1981 |
| EP | 0036384 | A2 | 9/1981 |
| EP | 0036384 | A3 | 3/1982 |
| EP | 0053270 | A1 | 6/1982 |
| EP | 0053270 | B1 | 7/1984 |
| EP | 0114024 | A1 | 7/1984 |
| EP | 0036384 | B1 | 11/1984 |
| EP | 0114024 | B1 | 3/1987 |
| EP | 0402517 | A1 | 12/1990 |
| EP | 0412395 | A1 | 2/1991 |
| EP | 0412398 | A1 | 2/1991 |
| EP | 0412399 | A1 | 2/1991 |
| EP | 0412400 | A1 | 2/1991 |
| EP | 0412402 | A1 | 2/1991 |
| EP | 0414926 | A1 | 3/1991 |
| EP | 0428778 | A1 | 5/1991 |
| EP | 0428783 | A1 | 5/1991 |
| EP | 0442344 | A2 | 8/1991 |
| EP | 0442344 | A3 | 4/1992 |
| EP | 0412402 | B1 | 4/1993 |
| EP | 0535765 | A2 | 4/1993 |
| EP | 0402518 | B1 | 9/1993 |
| EP | 0412399 | B1 | 1/1994 |
| EP | 0428783 | B1 | 1/1994 |
| EP | 0402517 | B1 | 3/1994 |
| EP | 0412400 | B1 | 3/1994 |
| EP | 0414926 | B1 | 3/1994 |
| EP | 0412395 | B1 | 9/1994 |
| EP | 0412398 | B1 | 9/1994 |
| EP | 0442344 | B1 | 1/1995 |
| EP | 0907805 | B1 | 1/2001 |
| EP | 0912806 | B1 | 9/2001 |
| EP | 2080730 | | 7/2009 |
| JP | 19780157033 | | 12/1978 |
| WO | 9746763 | A1 | 12/1997 |
| WO | 9746767 | A1 | 12/1997 |
| WO | 9847793 | A1 | 10/1998 |
| WO | 9902788 | A1 | 1/1999 |
| WO | 0004240 | A1 | 1/2000 |
| WO | 0140824 | A1 | 6/2001 |
| WO | 2005012028 | A1 | 2/2005 |
| WO | 2005118329 | A1 | 12/2005 |
| WO | 2007057305 | A1 | 5/2007 |
| WO | 2008144043 | A2 | 11/2008 |
| WO | 2008144043 | A3 | 2/2009 |
| WO | 2009024405 | A2 | 2/2009 |
| WO | 2006028938 | A1 | 3/2009 |
| WO | 2009/086601 | | 7/2009 |
| WO | 2009131635 | A2 | 10/2009 |
| WO | 2009131635 | A3 | 12/2009 |
| WO | 2010033959 | A1 | 3/2010 |
| WO | 2010132065 | A1 | 11/2010 |
| WO | 2010/149857 | | 12/2010 |

OTHER PUBLICATIONS

417OC Service Manual—Section 17 Crawler Maintenance, p. 127.

Autonomous Loading Application, Carnegie Mellon University Robotics Institute, National Robotics Engineering Center, Retrieved from Internet on Dec. 28, 2010 <URL: http://www.rec.ri.cmu.edu/projects/als/application/>.

Winstanley, G. et al., "Dragline Automation—A Decade of Development", IEEE Robotics & Automation Magazine, Sep. 2007, pp. 52-64.

First Office Action from the Chilean Patent Office for Application No. 0933-2012 dated Sep. 28, 2015 (10 pages).

* cited by examiner

SWING AUTOMATION FOR ROPE SHOVEL

RELATED APPLICATIONS

This application is a continuation of U.S. patent application Ser. No. 13/446,817, filed Apr. 13, 2012, now U.S. Pat. No. 8,768,579, which claims the benefit of U.S. Provisional Application No. 61/475,474, filed Apr. 14, 2011, the entire contents of both of which are hereby incorporated by reference.

BACKGROUND

The present invention relates to the movement of materials using rope shovels.

SUMMARY

Embodiments of the invention provide a system and method for various levels of automation of a swing-to-hopper motion for a rope shovel. An operator controls a rope shovel during a dig operation to load a dipper with materials. A controller, either via operator input or sensor data, receives position data for the dipper and for a hopper where the materials are to be dumped from the dipper. The controller then calculates an ideal path for the dipper to travel to be positioned above the hopper to dump the contents of the dipper. In some embodiments, the controller outputs operator feedback to assist the operator in traveling along the ideal path to the hopper. In some embodiments, the controller restricts the dipper motion such that the operator is not able to deviate beyond certain limits of the ideal path. In some embodiments, the controller automatically controls the movement of the dipper to reach the hopper. The embodiments of the invention are also applied to assist swinging the dipper back from the hopper to a tuck position at the dig location.

In one embodiment, a rope shovel including an automated swing system is provided. The rope shovel includes a swing motor, a hoist motor, a crowd motor, a dipper that is operable to dig and dump materials and that is positioned via operation of the hoist motor, crowd motor, and swing motor, and a controller. The controller includes an ideal path generator module that receives current dipper data and dump location information indicating a location at which the dipper is to dump materials therein. The ideal path generator calculates an ideal swing path, and based on the ideal swing path, further calculates an ideal hoist path and an ideal crowd path. The ideal path generator then outputs the ideal swing path, the ideal hoist path, and the ideal crowd path.

In another embodiment, a method of generating an ideal path for swinging a rope shovel is provided. The rope shovel includes a swing motor, a hoist motor, a crowd motor, and a dipper operable to dig and dump materials. The dipper is positioned via operation of the hoist motor, crowd motor, and swing motor. The method includes receiving current dipper data and dump location information indicating a location at which the dipper is to dump materials therein. The method further includes calculating an ideal swing path and, based on the ideal swing path, further calculating an ideal hoist path and an ideal crowd path. The ideal swing path, the ideal hoist path, and the ideal crowd path are then outputted.

In another embodiment, a rope shovel including an automated swing system is provided. The rope shovel includes a swing motor, a hoist motor, a crowd motor, a dipper that is operable to dig and dump materials and that is positioned via operation of the hoist motor, crowd motor, and swing motor, and a controller. The controller includes an ideal path generator module that receives current dipper data and dump location information indicating a location at which the dipper is to dump materials therein. The ideal path generator calculates at least one of an ideal swing path, an ideal hoist path, and an ideal crowd path. The ideal path generator then outputs the ideal swing path, the ideal hoist path, and the ideal crowd path.

In some embodiments, the ideal path generator module further receives a swing aggressiveness level from an operator, wherein the ideal swing path is calculated based on the swing aggressiveness level. Additionally, the dump location information may be received from one of global positioning satellite (GPS) data and a memory storing a location of an previous operator-controlled dump. The rope shovel may further include a feedback module that receives the current dipper data including a current swing motor position, current hoist motor position, and current crowd motor position; receives the ideal swing path, the ideal hoist path, and the ideal crowd path, and provides an operator with at least one of audio, visual, and tactile feedback of the current dipper data relative to the dump location information. The feedback module may illustrate the dump location information and current dipper data to the operator, e.g., via a display.

In some embodiments, the rope shovel also includes a boundary generator module that receives the current dipper data including a current swing motor position, current hoist motor position, and current crowd motor position; receives the ideal swing path, the ideal hoist path, and the ideal crowd path; and generates boundaries for the ideal hoist path and the ideal crowd path.

In some embodiments, the rope shovel further includes a dipper control signal module that receives (a) the boundaries from the boundary generator module, (b) the current dipper data, and (c) operator controls for controlling movement of the dipper via the hoist motor, crowd motor, and swing motor. The dipper control signal module further compares the current dipper data to the boundaries, and when the current dipper data indicates that at least one of the hoist motor and crowd motor is at or outside of the boundaries, adjusts the operator controls to maintain the hoist motor and crowd motor within the boundaries. The boundaries may be one of a ramp function, a constant window, and a polynomial curve.

In some embodiments, the dipper control signal module receives the ideal swing path, ideal hoist path, and the ideal crowd path. In response, the dipper control signal module outputs control signals to control the swing motor, the hoist motor, and the crowd motor according to the ideal swing path, the ideal hoist path, and the ideal crowd path, respectively.

In some embodiments, the rope shovel further includes a mode selector module that receives an operator mode selection that indicates one of at least three modes of swing automation, and controls the rope shovel to operate in the selected swing automation mode. The at least three modes of operation may include at least three of the following: no swing automation mode, trajectory feedback mode, teach mode, motion restriction mode, and full automation mode. Additionally, the mode selector module may receive system information indicating at least one equipment fault, and as a result, control the rope shovel to operate in a different swing automation mode.

In some embodiments, the rope shovel further includes a hopper alignment system including at least one of a camera and a laser scanner. The hopper alignment system determines when the dipper is within a predetermined range of the dump location, and controls the dipper control signal module to perform visual servoing of the dipper to align the dipper with the dump location.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
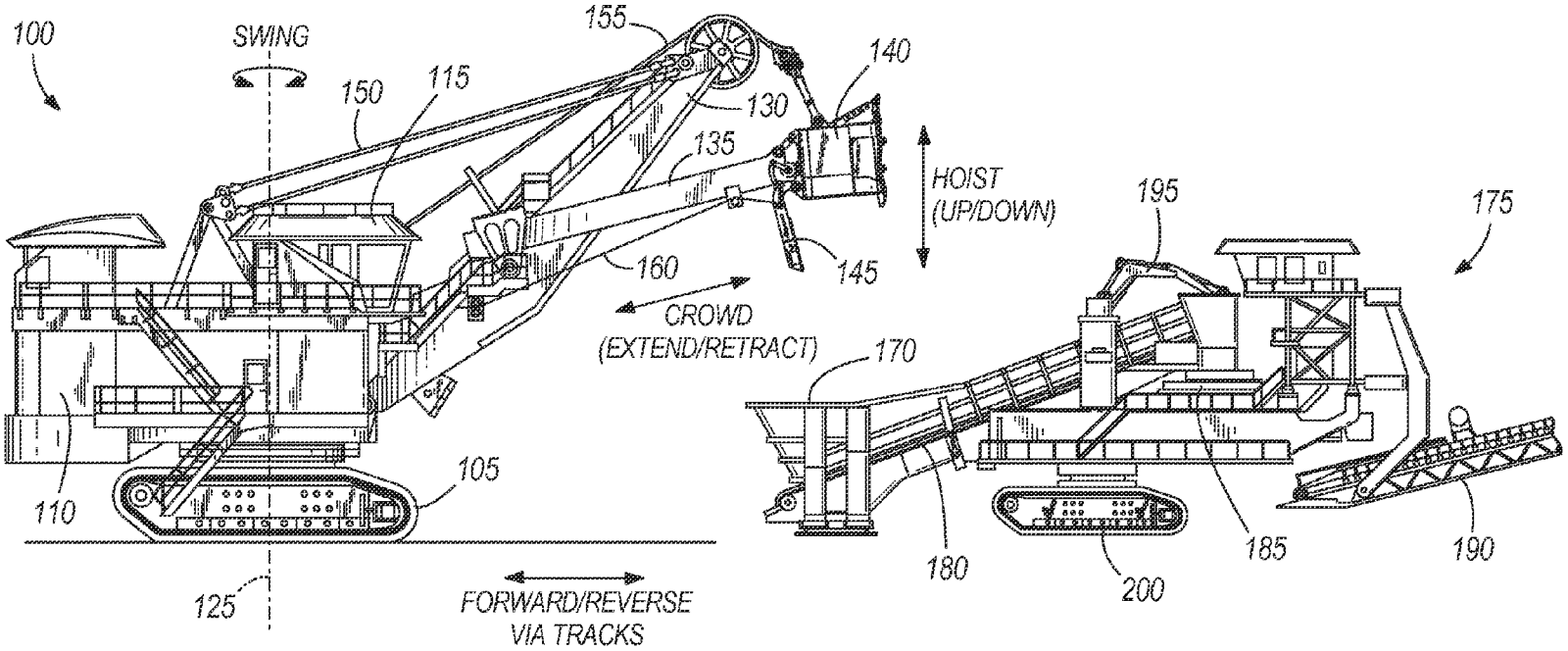
FIG. 1 depicts an exemplary rope shovel and mobile mining crusher according to embodiments of the invention.

FIG. 1 depicts an exemplary rope shovel 100. The rope shovel 100 includes tracks 105 for propelling the rope shovel 100 forward and backward, and for turning the rope shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location. Movement of the tracks 105 is not necessary for the swing motion. The rope shovel further includes a dipper shaft 130 supporting a pivotable dipper handle 135 (handle 135) and dipper 140. The dipper 140 includes a door 145 for dumping contents within the dipper 140.

The rope shovel 100 also includes taut suspension cables 150 coupled between the base 110 and dipper shaft 130 for supporting the dipper shaft 130; a hoist cable 155 attached to a winch (not shown) within the base 110 for winding the cable 155 to raise and lower the dipper 140; and a crowd cable 160 attached to another winch (not shown) for extending and retracting the dipper 140. In some instances, the rope shovel 100 is a P&H® 4100 series shovel produced by P&H Mining Equipment Inc.

FIG. 1 also depicts a mobile mining crusher 175. During operation, the rope shovel 100 dumps materials within the dipper 140 into a hopper 170 by opening the door 145. Although the rope shovel 100 is described as being used with the mobile mining crusher 175, the rope shovel 100 is also able to dump materials from the dipper 140 into other material collectors, such as a dump truck (not shown) or directly onto the ground.

The mobile mining crusher 175 includes the hopper 170 to receive materials from the dipper 140 and a conveyor or apron feeder 180 to transport the materials to a crusher 185. The crusher 185 crushes materials received from the apron feeder 180, and outputs the crushed material along the output conveyor 190. In some instances, the crusher 185 is a twin roll crusher with a capacity to crush approximately 10 metric tons per hour. The mobile mining crusher 175 also includes a boom 195 with a hammer/breaker at its distal end to break materials, for instance, on the apron feeder 180. The mobile mining crusher 175 is also able to turn and to propel forward and backward using the tracks 200. In some instances, the mobile mining crusher is a 4170C™ Mobile Mining Crusher produced by P&H Mining Equipment Inc. The mobile mining crusher 175 is sometimes also referred to an in-pit-crushing and conveying (IPCC) system.

Figure 2A:
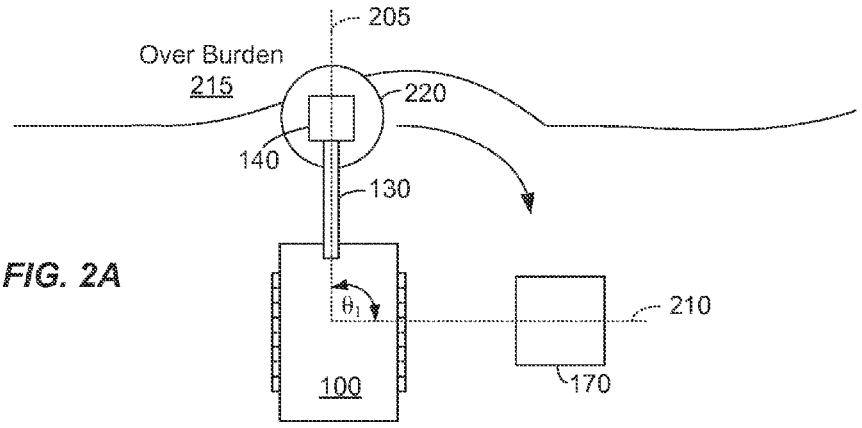
FIGS. 2A-C depict a swing of a rope shovel between a dig location and a dumping location.
Figure 2B:
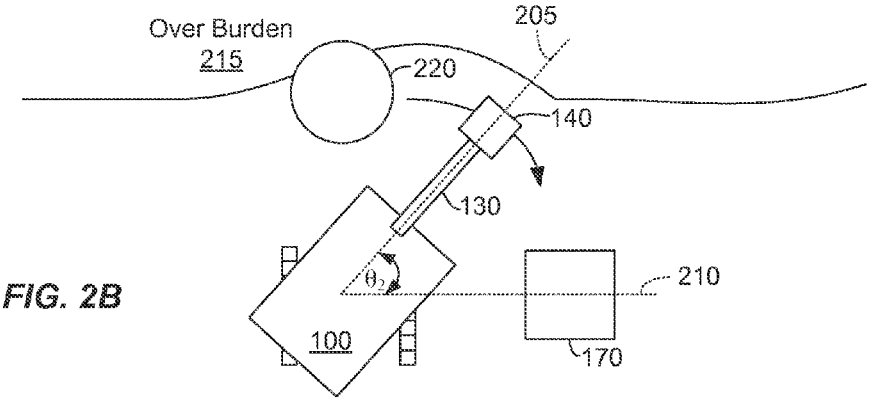
Figure 2C:
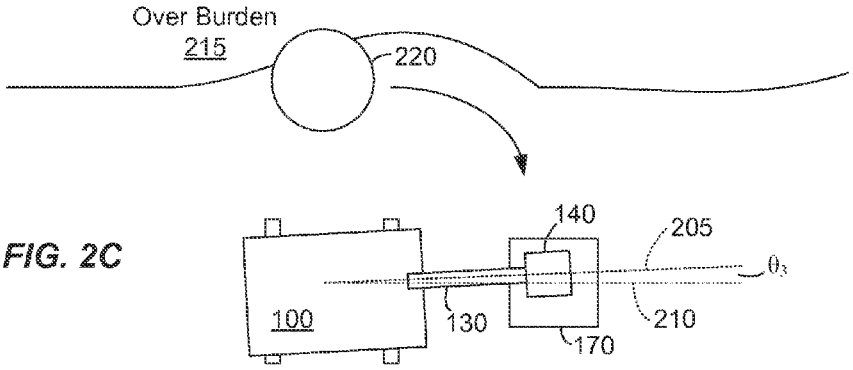

FIGS. 2A-C depicts exemplary swing angles of the rope shovel 100 moving from a dig position to a dump position. For reference purposes, a shaft axis 205 and hopper axis 210 are overlaid on FIGS. 2A-C, with the swing axis 125 being the intersection of the shaft axis 205 and hopper axis 210. The angle between the shaft axis 205 and the hopper axis 210 is referred to as $\theta$. In FIG. 2A, the dipper shaft 130 digs with dipper 140 into overburden 215 at a dig location 220, and $\theta=\theta_1$. After digging, the rope shovel 100 begins to swing the dipper shaft 130 towards the hopper 170. In FIG. 2B, the dipper shaft 130 is mid-way through the swing-to-hopper and $\theta=\theta_2$. In FIG. 2C, the dipper shaft 130 has stopped over the hopper 170 and the door 145 is released to dump the materials within the dipper 140 into the hopper 170, with $\theta=\theta_3$.

Rope shovels such as the rope shovel 100 have the capacity to gather many tons of material from a single dig. For instance, in some embodiments, the dipper 140 has a capacity for a nominal payload of nearly 100 metric tons and over 50 $m^3$ of material. In other embodiments, the rope shovel 100 has a larger or smaller capacity. With such a large amount of material collected by a single dig, it is desirable to properly locate the dipper 140 above the hopper 170 before releasing the door 145 to avoid missing the hopper and spilling materials. Additionally, it is generally desirable to improve the speed between the dig and dump cycles to improve overall efficiency and increase the rate at which of materials are moved. In some instances, rope shovel operators build up skill and technique over years of experience to ensure quick, safe, and efficient swing-to-dump motions with the rope shovel 100.

When the tracks 105 of the rope shovel 100 are static, the dipper 140 is operable to move based on three control actions: hoist, crowd, and swing. As noted above, the hoist control raises and lowers the dipper 140 by winding and unwinding hoist cable 155. The crowd control extends and retracts the position of the handle 135 and dipper 140. The swing control swivels the handle 135 relative to the swing axis 125 (see, e.g., FIGS. 2A-C). Before dumping its contents, the dipper 140 is maneuvered to the appropriate hoist, crowd, and swing position to 1) ensure the contents do not miss the hopper 170; 2) the door 145 does not hit the hopper 170 when released; and 3) the dipper 140 is not too high such that the released contents would damage the hopper 170 or cause other undesirable results.

Figure 3:
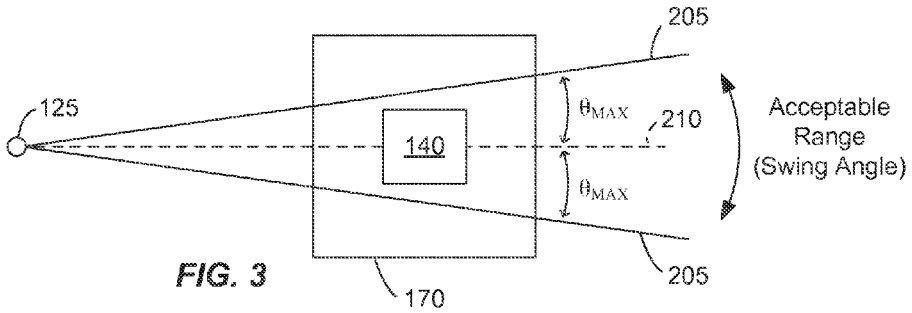
FIGS. 3-5 depict alignment of a dipper over a hopper of a mobile mining crusher.
Figure 4:
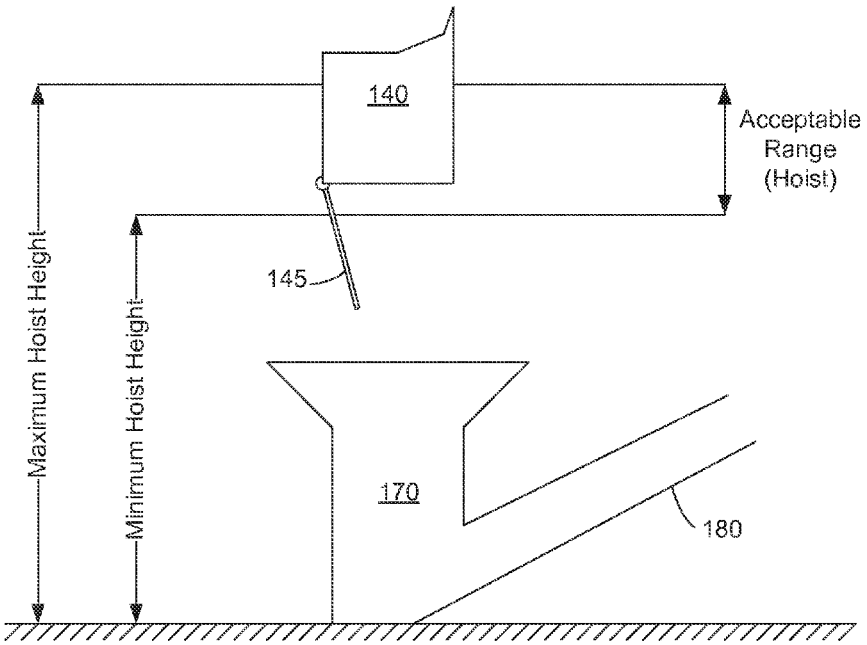
Figure 5:
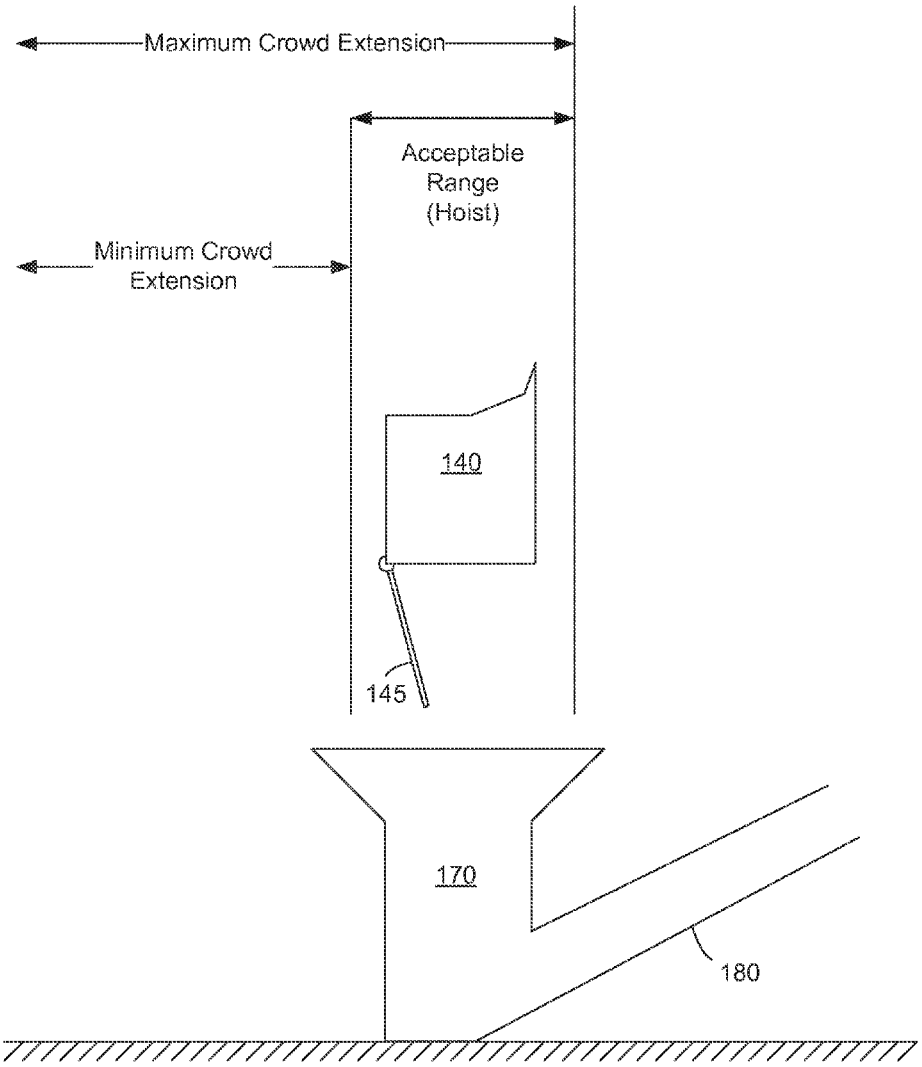

FIGS. 3-5 depict acceptable windows for the swing, hoist, and crowd position of the bucket, respectively. As shown in FIG. 3, the acceptable range for the swing angle (θ) of the dipper 140 is $+/-\theta_{MAX}$ from the axis 210 through the hopper 170 (using the convention from FIGS. 2A-C). FIG. 4 depicts an acceptable range for the height of the dipper 140 above the hopper 170 as being between the maximum hoist height and the minimum hoist height. FIG. 5 depicts an acceptable range for the extension of the dipper 140 above the hopper 170 as being between the maximum crowd extension and minimum crowd extension. While these ranges are described with respect to dumping in a hopper 170, as noted above, the dipper 140 may dump materials in other areas, such as a dump truck bed on a material pile directly on the ground. These various dump areas, as well as the hopper 170, may be referred to as "dump locations."

Figure 6:
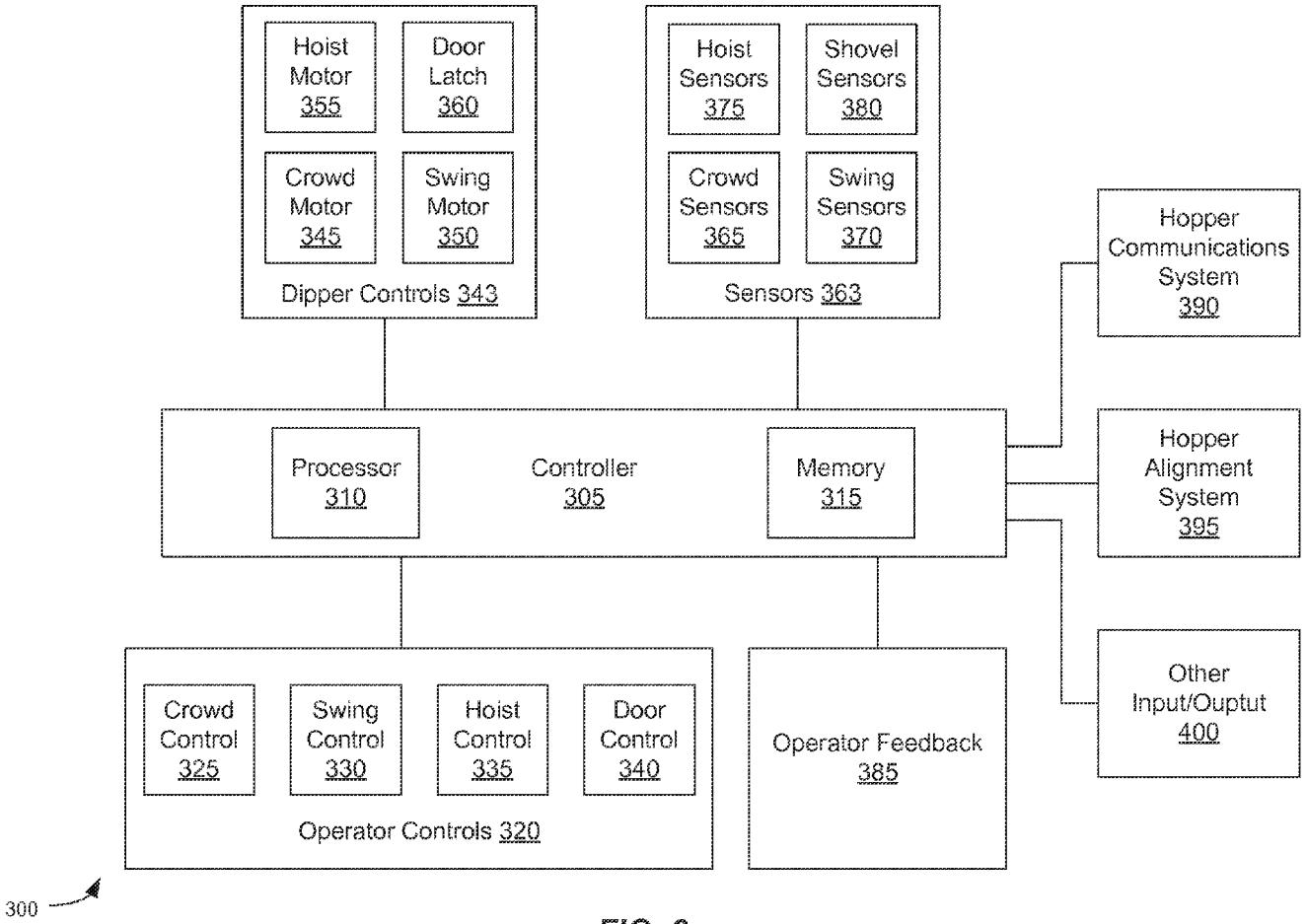
FIG. 6 depicts a control system for swing automation according to embodiments of the invention.

The rope shovel 100 includes a control system 300 including a swing automation controller (controller) 305, as shown in FIG. 6. The controller 305 includes a processor 310, a memory 315 for storing instructions executable by the processor 310, and various inputs/outputs for, e.g., allowing communication between the controller 305 and the operator or between the controller 305 and sensors that provide feedback regarding various machine parameters. In some instances, the controller 305 is a microprocessor, digital signal processor (DSP), field programmable gate array (FPGA), application specific integrated circuit (ASIC), or the like.

The controller 305 receives input from operator controls 320, which includes a crowd control 325, swing control 330, hoist control 335, and door control 340. The crowd control 325, swing control 330, hoist control 335, and door control 340 include, for instance, operator controlled input devices such as joysticks, levers, foot pedals, and other actuators. The operator controls 320 receive operator input via the input devices and outputs digital motion commands to the controller 305. The motion commands include, for example, hoist up, hoist down, crowd extend, crowd retract, swing clockwise, swing counterclockwise, dipper door release, left track forward, left track reverse, right track forward, and right track reverse. Upon receiving a motion command, the controller 305 generally controls dipper controls 343, which includes one or more of a crowd motor 345, swing motor 350, hoist motor 355, and shovel door latch 360, as commanded by the operator. For instance, if the operator indicates via swing control 330 to rotate the handle 135 counterclockwise, the controller 305 will generally control the swing motor 350 to rotate the handle 135 counterclockwise. As will be explained in greater detail, however, the controller 305 is operable to limit the operator motion commands and generate motion commands independent of the operator input in some embodiments of the invention.

The controller 305 is also in communication with a number of sensors 363 to monitor the location and status of the dipper 140. For example, the controller 305 is coupled to crowd sensors 365, swing sensors 370, hoist sensors 375, and shovel sensors 380. The crowd sensors 365 indicate to the controller 305 the level of extension or retraction of the dipper 140. The swing sensors 370 indicate to the controller 305 the swing angle of the handle 135. The hoist sensors 375 indicate to the controller 305 the height of the dipper 140 based on the hoist cable 155 position. The shovel sensors 380 indicate whether the dipper door 145 is open (for dumping) or closed. The shovel sensors 380 may also include weight sensors, acceleration sensors, and inclination sensors to provide additional information to the controller 305 about the load within the dipper 140. In some embodiments, one or more of the crowd sensors, swing sensors 370, and hoist sensors 375 are resolvers that indicate an absolute position or relative movement of the crowd motor 345, swing motor 350, and/or hoist motor 355. For instance, for indicating relative movement, as the hoist motor 355 rotates to wind the hoist cable 155 to raise the dipper 140, the hoist sensors 375 output a digital signal indicating an amount of rotation of the hoist and a direction of movement. The controller 305 translates these outputs to a height position, speed, and/or acceleration of the dipper 140. Of course, the crowd sensors 365, swing sensors 370, hoist sensors 375, and shovel sensors 380 incorporate other types of sensors in other embodiments of the invention.

The operator feedback 385 provides information to the operator about the status of the rope shovel 100 and other systems communicating with the rope shovel 100 (e.g., the hopper 170). The operator feedback 385 includes one or more of the following: a display (e.g. a liquid crystal display (LCD)); one or more light emitting diodes (LEDs) or other illumination devices; a heads-up display (e.g., projected on a window of cab 115); speakers for audible feedback (e.g., beeps, spoken messages); tactile feedback devices such as vibration devices that cause vibration of the operator's seat or operator controls 320; or another feedback device. Specific implementation details of the operator feedback 385 are described more particularly below.

In some embodiments, the controller 305 also communicates with hopper communications system 390 and a hopper alignment system 395. For instance, the hopper communications system 390 is operable to send production data and status data to the controller 305. Exemplary production data includes hours of use, amount of material input, amount of material output, etc. Exemplary status data includes weight and height of the current load within the hopper 170, an indication of whether the apron feeder 180, crusher 185, and output conveyor 190, are currently enabled and related speeds of operation, whether the boom 195 is being operated, whether the mobile mining crusher 175 is being moved (e.g., via tracks 200) or the hopper or other portions of the mobile mining crusher 175 are being repositioned (e.g., with the tracks 200 immobile), as well as other status information. In some embodiments, the door 145 is prevented form being opened when the controller 305 receives an indication via hopper communications system 390 that the hopper 170 is full or otherwise unable to accept a load from dipper 140.

The hopper alignment system 395 includes, for instance, global positioning satellite (GPS) modules, optical cameras and image processing, and/or a scanning laser. The hopper alignment system 395 enables the controller 305 to obtain positioning information to align the dipper 140 with the hopper 170, particularly in a full automation mode described below. In some embodiments, the controller 305 includes other input and/or output (I/O) devices 400, such as a keyboard, mouse, external hard drives, wireless or wired communication devices, etc.

The control system 300 is part of a swing automation system of the rope shovel 100. The swing automation system provides various levels of assistance to an operator of the rope shovel 100. The swing automation system includes multiple modes of operation including at least: 1) a trajectory feedback mode; 2) a motion restriction mode; 3) a teach mode; and 4) a full automation mode. In some instances, the modes are designed in a modular fashion such that each mode builds upon features and components of a previous mode. For instance, the motion restriction mode builds on the trajectory feedback mode; the teach mode builds on the motion restriction mode; and the full automation mode builds on the teach mode. Using a common architecture and developing a module approach to component integration allows for a robust system that can react to the loss of sensors or information by reducing the complexity of the system down to a mode that can remain fully operational. The approach also allows for safer integration, testing, and prototyping, as well as expanding upon the technology with future sensor integration and customer requirements. Additionally, features and components from the various modes may be combined to form hybrid modes in some embodiments, as will become apparent from the disclosure herein.

In the trajectory feedback mode, the controller 305 identifies an ideal path that the rope shovel 100 should follow to position the dipper 140 correctly for dumping into the hopper 170. As the operator swings the dipper 140 to the hopper 170, the controller 305 provides the operator one or more forms of feedback via operator feedback 385 about the position and motion of the dipper 140 with respect to the ideal path. In the trajectory restriction mode, the controller 305 enforces an upper and lower boundary from the ideal path. Through the upper and lower boundaries, the controller 305 prevents the dipper 140 from deviating too far from the ideal path to the hopper 170. The teach mode enables a semi-autonomous operation of swing, crowd, and hoist controls. The operator first designates a dump location (e.g., a location of the hopper 170). After performing a dig operation, the operator initializes an automated swing phase (e.g., using operator controls 320). The controller 305 then controls the dipper 140 to follow the ideal path to reach the programmed dump location. In the full automation mode, after initiation, no active input from the operator is required to perform the swing phase. The position and orientation of the hopper 170 is actively measured with respect to the dipper 140 to identify the dumping location, generate an ideal path, and control the dipper 140 along the ideal path to reach the dumping location.

Trajectory Feedback Mode

The trajectory feedback mode includes: 1) generating of an ideal path for the dipper 140 to proceed along from the dig location 220 to the hopper 170 and to return along to the dig location 220; and 2) providing the operator visual, audible, or tactile feedback to indicates the variance of the dipper 140 from the ideal path. The trajectory feedback mode suggests to the operator an ideal path, but does not actively control the dipper 140. Thus, the trajectory feedback mode enables testing and analysis of the generated ideal path to diagnose issues and improve generation of the ideal path without concern that the controller 305 will control the dipper 140 improperly. To this end, the controller 305 is operable to output a comparison between the operator's actual path and the generated ideal path. The comparison is output to the operator via operator feedback 385 and/or output to an external device, e.g., for review by a supervisor. The external device may be local (e.g., another computer on-board the rope shovel 100), on-site (e.g., a laptop, tablet, or smart phone of a supervisor in a nearby vehicle or facility), or off-site (a computer device coupled via a network, such as the Internet).

Figure 7:
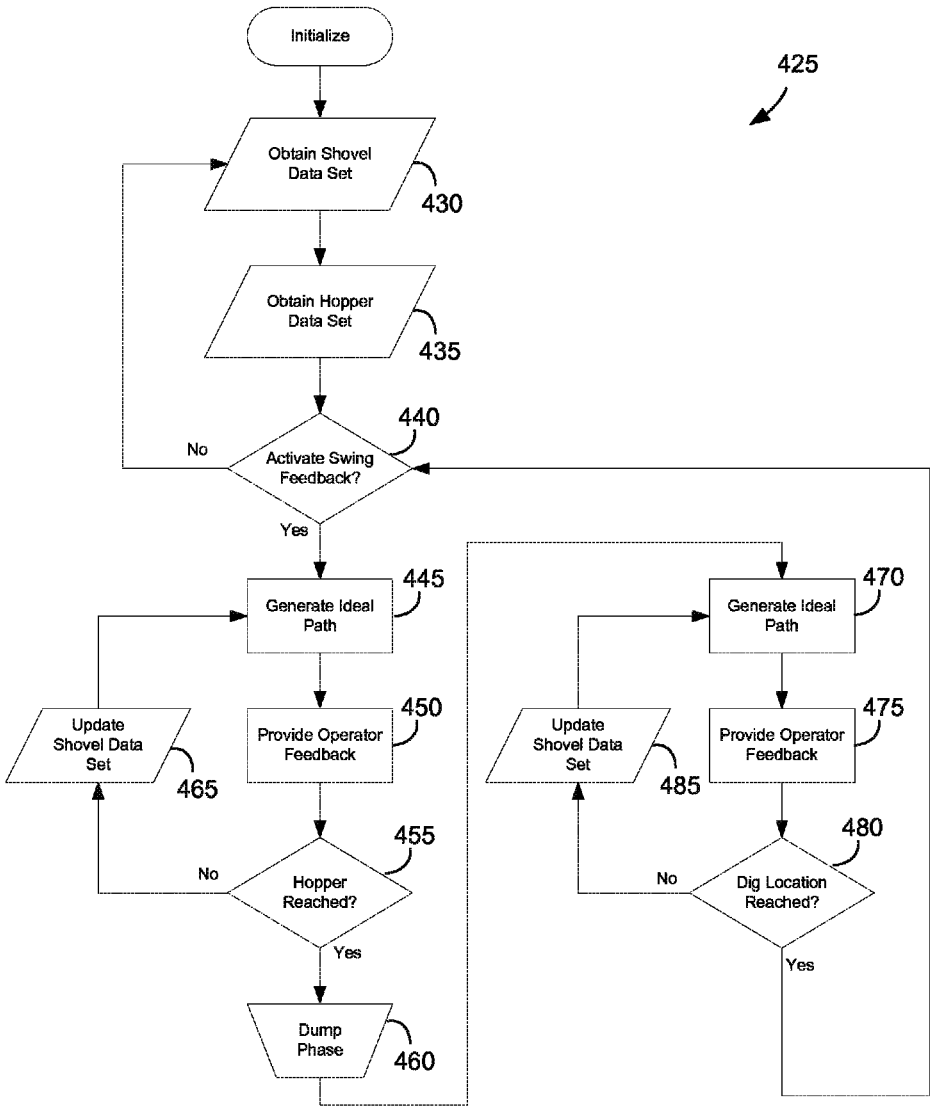
FIG. 7 depicts a method for an operator feedback mode according to embodiments of the invention.

FIG. 7 depicts a trajectory feedback method 425 using the control system 300. In step 430, a shovel data set is obtained by the controller 305, e.g., using sensors 363 and operator controls 320. As shown in Table 1, the shovel data set includes variables related to the position, movement, and state of the dipper 140.

TABLE 1

| Shovel Data Set | | |
|---|---|---|
| Swing Motor Speed | Hoist Motor Speed | Crowd Motor Speed |
| Swing Motor Speed | Hoist Motor Speed | Crowd Motor Speed |

TABLE 1-continued

| Shovel Data Set | | |
|---|---|---|
| Limit | Limit | Limit |
| Swing Motor Ramp Rate | Hoist Motor Ramp Rate | Crowd Motor Ramp Rate |
| Swing Motor Joystick Reference | Hoist Motor Joystick Reference | Crowd Motor Joystick Reference |
| Swing Resolver Position | Hoist Resolver Position | Crowd Resolver Position |
| Swing Motor-to-Resolver Ratio | Hoist Motor-to-Resolver Ratio | Crowd Motor-to-Resolver Ratio |
| Swing Motor Torque | Swing Motor Torque Limit | Dipper Door State |

In step 435, the controller 305 obtains a hopper data set. As shown in Table 2, the hopper data set includes the desired swing, hoist, and crowd position to position the dipper 140 above the hopper 170. In some embodiments, the hopper data set is obtained based on a previous operator dump operation. In other words, the swing, hoist, and crowd position at the time of the previous opening of the door 145 via door latch 360, as determined by the sensors 363, is recorded as the hopper data set. This hopper data set is presumed to be the ideal position for the unloading of the dipper 140 (e.g., over the hopper 170) when generating the ideal trajectory. In other embodiments, the hopper data set is determined using data from the hopper alignment system 395 or via the operator manually inputting the resolver count data.

TABLE 2

| Hopper Data Set | |
|---|---|
| $SRC_d$: Swing Resolver Count (Dump Position) | $CRC_d$: Crowd Resolver Count (Dump Position) |
| $HRC_d$: Hoist Resolver Count (Dump Position) | Dipper Door State |

In step 440, the controller 305 determines whether to activate swing feedback. In some embodiments, the operator indicates to the controller 305 via an actuator (e.g., a button) to activate swing feedback. In other embodiments, the controller 305 automatically activates swing feedback after detecting the completion of a dig cycle of the dipper 140 and the beginning of a swing-to-hopper operation. For instance, by monitoring the shovel data set, the controller 305 detects when one or more variables within the shovel data set (e.g., swing speed or position, hoist speed or position, crowd speed or position) exceed certain thresholds that indicate a swing-to-hopper operation has likely started (see, e.g., FIG. 22).

In step 445, the controller 305 generates an ideal path for the dipper 140 to arrive at the stored ideal dump position above the hopper 170. To generate the ideal path, the processor 310 executes an algorithm including one or more of the shovel data set parameters and the hopper data set parameters. The ideal path is generated such that the dipper 140 will be moved at or near the performance limits of the swing, hoist and crowd motions. However, the operator may specify that a less aggressive ideal path be generated such that the dipper 140 will be moved at a rate lower than the performance limits of the rope shovel 100. The aggressiveness level may be included, for instance, as part of the shovel data set.

To generate an ideal path in step 445, an accurate profile of the swing motion, including the swing speed, acceleration and deceleration, is determined. One aspect of the ideal path is to calculate the time needed to decelerate the dipper 140 and the point at which to begin decelerating. When the operator begins the swing phase the maximum acceleration rate ($\ddot{\theta}_s$) is calculated as follows $$\ddot{\theta}_s = \frac{d\dot{\theta}_s}{dt},$$

where $\dot{\theta}_s$ is the revolutions per minute (RPM) of the swing motor 350. The acceleration rate is measured during the initial portion of the swing, i.e., while maximum torque is being applied by the swing motor 350. When digging on level ground or at a downward slope, the deceleration rate ($\ddot{\theta}_{decel}$) is assumed to be greater then the acceleration rate (i.e., $\ddot{\theta}_{decel} \geq \ddot{\theta}_{accel}$). In turn, the deceleration rate ($\ddot{\theta}_{decel}$) is estimated to be the acceleration rate $\ddot{\theta}_{accel}$, since it is unlikely the estimated deceleration will yield an overshoot. Thus, $\ddot{\theta}_{decel} \cong \ddot{\theta}_{accel}$.

Using the estimated deceleration rate ($\ddot{\theta}_{decel}$) and the current, measured swing speed of the dipper 140 ($\dot{\theta}_s$), the controller 305 generates an estimated time required to decelerate the swing of the dipper 140 to line up above the hopper 170 with the following equation:

$$t_{decel} = \frac{\dot{\theta}_t}{\ddot{\theta}_{decel}}.$$

The amount of swing resolver displacement to return the swing speed ($\dot{\theta}_s$) of the dipper 140 to zero is estimated using the equation for displacement given constant acceleration, or, in this case, deceleration. In other words, $$\Delta SRC_{decel} = SwgRatio * \left(\dot{\theta}_t * t_{decel} + \frac{1}{2} * \ddot{\theta}_{decel} * t_{decel}^2\right),$$

where SwgRatio is the ratio between the swing motor pinion and the swing resolver. As the dipper 140 is swung towards the hopper 170, the current swing resolver count $SRC_t$ and $\Delta SRC_{decel}$ are continually updated. Based on the aforementioned calculations, the controller 305 estimates that, given the current speed and position of the dipper 140 and the position of the hopper 170, beginning to decelerate when $SRC_t - SRCd = \Delta SRC_{decel}$ (i.e., when the swing reversal trigger condition is true), will result in the controller 305 stopping the swing of the dipper 140 above the hopper 170 for dumping. Thus, once $SRC_t - SRCd = \Delta SRC_{decel}$, the swing of dipper 140 starts to decelerate by reversing the swing motor 350.

Additionally, the controller 305 calculates the time remaining in the swing to the hopper 170 ($t_{rem}$) based on the remaining swing resolver counts to the hopper 170 ($SRC_{rem}$). The remaining swing resolver counts to the hopper 170 ($SRC_{rem}$) is calculated assuming the current velocity is constant and using the following equation: $SRC_{rem} = SRC_t - SRC_d - \Delta SRC_{decel}$. In turn, the time remaining in the swing to the hopper 170 ($t_{rem}$) is calculated using the following equation:

$$t_{rem} = t_{decel} + \frac{SRC_{rem}}{SwgRatio * \dot{\theta}_t}.$$

The controller 305 continuously calculates the above-noted equations to maintain accurate estimations of swing deceleration rates and the appropriate time to begin deceleration.

Using the time remaining in the swing to the hopper 170 ($t_{rem}$), the controller 305 estimates the desired hoist and crowd trajectory of the dipper 140. The following naming conventions are used: $HRC_{t0}$ is the initial hoist position at the start of the swing phase ($t=t_0$); $HRC_t$ is the current hoist position; $HRC_d$ is the desired hoist position of the dipper 140 above the hopper 170; $CRC_{t0}$ is the initial crowd position at the start of the swing phase ($t=t_0$); $CRC_t$ is the current crowd position; and $CRC_d$ is the desired crowd position of the dipper 140 above the hopper 170.

The desired speed ($\dot{\theta}_d$) of the hoist motor 355 is calculated continuously using the following equation:

$$\dot{\theta}_d = HstRatio * \left(\frac{HRC_d - HRC_t}{t_{rem}}\right),$$

where $t_{rem}$ is the time remaining in the swing to the hopper 170 described above and HstRatio is a gain parameter equal to the ratio between the shaft speed of the hoist motor and the count speed of the hoist resolver. This equation assumes that the dipper 140 will arrive at the desired hoist position $HRC_d$ above the hopper 170 simultaneously with the dipper 140 arriving at the proper swing position $SRC_d$ above the hopper 170. The equation is modified in other embodiments to have the dipper 140 reach the desired hoist position $HRC_d$ before reaching the desired swing position $SRC_d$ (e.g., reducing the value of $t_{rem}$). By continuously calculating $\dot{\theta}_d$, the controller 305 is able to adjust the ideal $\dot{\theta}_d$ if the operator is moving the hoist motor too fast or too slow relative to the ideal hoist path.

The desired speed ($\dot{\theta}_d$) of the crowd motor 345 is calculated continuously using the following equation:

$$\dot{\theta}_d = CwdRatio * \left(\frac{CRC_d - CRC_t}{t_{rem}}\right),$$

where $t_{rem}$ is the time remaining in the swing to the hopper 170 described above and CwdRatio is a gain parameter equal to the ratio between the shaft speed of the crowd motor and the count speed of the crowd resolver. This equation assumes that the dipper 140 will arrive at the desired crowd position $CRC_d$ above the hopper 170 simultaneously with the dipper 140 arriving at the proper swing position $SRC_d$ above the hopper 170. Again, the equation is modified in other embodiments to have the dipper 140 reach the desired crowd position $CRC_d$ before reaching the desired swing position $SRC_d$ (e.g., by reducing the value of $t_{rem}$). By continuously calculating $\dot{\theta}_d$, the controller 305 is able to adjust the ideal $\dot{\theta}_d$ if the operator is moving the crowd motor too fast or too slow relative to the ideal crowd path.

After generating an initial ideal path at time=$t_0$ in step 445, the controller 305 outputs feedback via operator feedback 385 in step 450. For instance, the controller 305 outputs the desired hoist, crowd, and swing trajectory simultaneously to the operator. The particular methods and systems used to provide feedback to the operator are described in greater detail below. In general, however, the feedback indicates to the operator whether the hoist, crowd, and swing motions of the dipper 140 are following the ideal path generated in step 445. In step 455, the controller 305 determines whether the dipper 140 has reached the hopper 170. In other words, in step 455, the controller 305 determines whether $CRC_d = CRC_t$; $HRC_d = HRC_t$; and $SRC_d = SRC_t$. If the dipper 140 has reached the hopper 170, the operator causes the dipper door 145 to open in step 460, e.g., by activating the door latch 360 via door control 340.

If the dipper 140 has not reached the hopper 170, the controller 305 obtains an updated shovel data set in step 465. Thereafter, the controller 305 returns to step 445 to re-generate the ideal path to the hopper 170 using the updated shovel data set obtained in step 465. By continuously cycling through steps 445, 450, 455, and 465 while moving the dipper 140 to the hopper 170, the controller 305 continuously updates the ideal path to the hopper 170 based on current conditions and provides updated feedback to the operator.

Upon reaching the hopper 170 as determined in step 455 and dumping the load of the dipper 140 in step 460, the controller 305 proceeds to step 470 to generate an ideal return path back to the dig location 220. Generating an ideal return path in step 470, providing operator feedback in step 475, determining whether the dig location 220 is reached in step 480, and updating the shovel data set in step 485 are similar to steps 445, 450, 455, and 465, respectively. The equations described above with respect to steps 445, 450, 455, and 465 apply to the steps 470, 475, 480, and 485, respectively, with the exception that the start and end positions of the crowd, hoist, and swing are swapped. Thus, the equations described above with respect to steps 445, 450, 455, and 465 apply to the steps 470, 475, 480, and 485, with the exception that $CRC_{t0}$, $HRC_{t0}$, and $SRC_{t0}$ are replaced with the corresponding crowd, hoist, and swing position of the hopper 170 and $CRC_d$, $HRC_d$, and $SRC_d$ are replaced with the corresponding crowd, hoist, and swing position of the dig location 220

In some embodiments, the controller 305 recalls the initial crowd, hoist, and swing position at time $t_0$ (i.e., $CRC_{t0}$, $HRC_{t0}$, and $SRC_{t0}$) and uses them as the desired destination, since they represented the dipper 140 position at the start of the swing-to-hopper motion. In other embodiments, the operator stores the desired dig location 220 in the controller 305 by activating an actuator (e.g., that is part of other I/O devices 400) when the dipper 140 is at the desired dig location 220. In some embodiments, the crowd and hoist positions of a tuck position for the dipper 140 are stored as the desired crowd and hoist positions. Using these tuck position values, at the completion of the swing to the dig location 220, the dipper 140 is in a tuck position and ready to begin the next dig cycle. The tuck position values for the crowd and hoist may be stored by the operator using an actuator, may be inferred by the controller based on the previous start of a dig cycle, or may be preset values (e.g., during a manufacturing process). As the dipper 140 is moved into the tuck position, gravity closes the door 145, allowing for the shovel door latch 360 to engage to keep the door closed until the next dump operation.

As noted above, various forms of feedback may be provided in steps 450 and 475 to the operator via operator feedback 385. In some embodiments, a visual output system is employed as part of the operator feedback 385. In some embodiments, audio feedback and/or tactile feedback is provided either in addition or in place of the visual output system.

Figure 8:
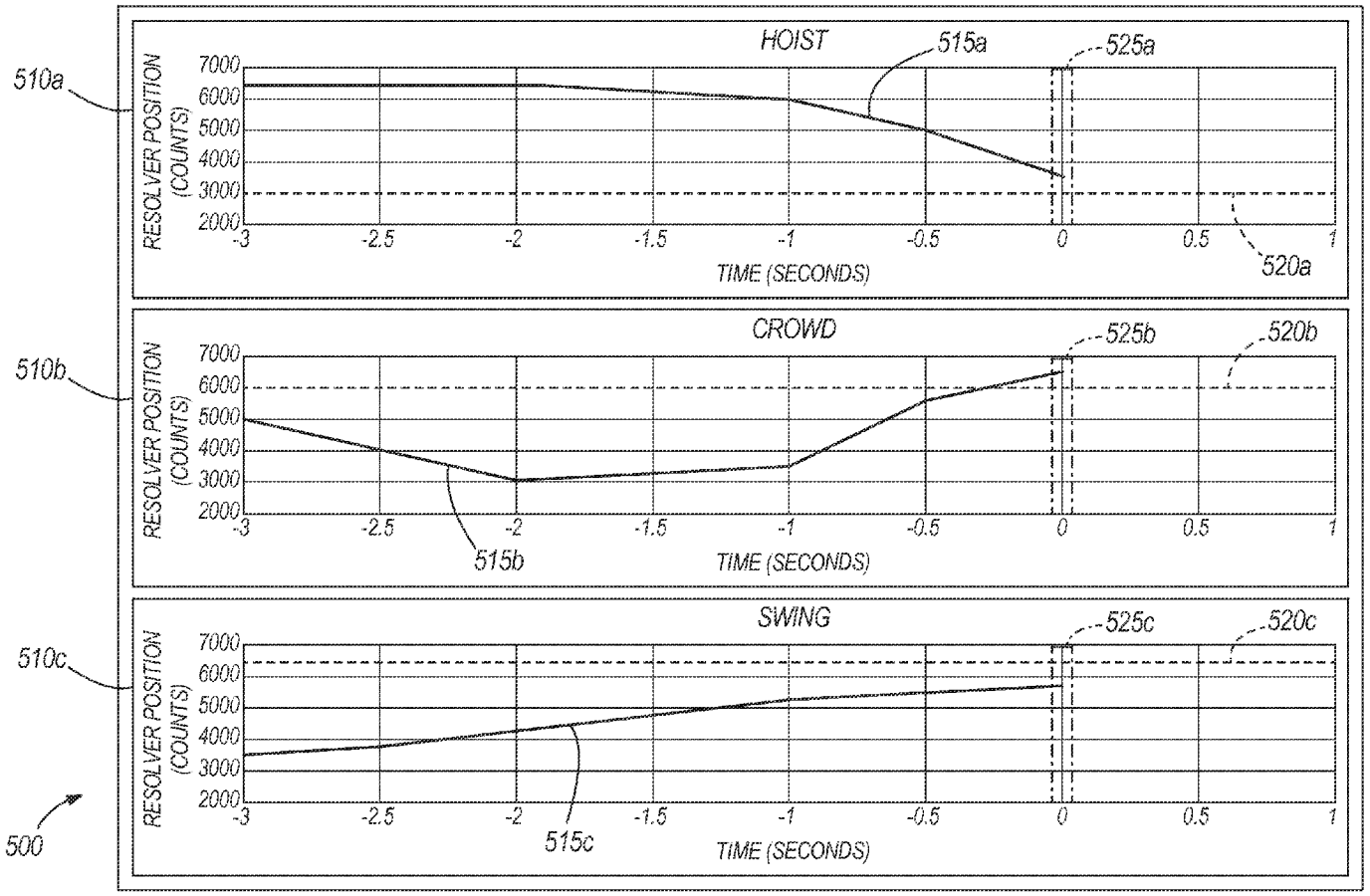
FIGS. 8-10 depict various operator feedback systems according to embodiments of the invention.

FIG. 8 depicts a floating trend window feedback system 500 (FTW system 500). In the FTW system 500, the operator feedback 385 includes a display screen 505 that independently depicts the ideal path for the hoist, crowd, and swing of the dipper 140, as well as the current hoist, crowd, and swing position of the dipper 140. The display screen 505 includes a hoist window 510*a*, a crowd window 510*b*, and a swing window 510*c*. The hoist window 510*a*, crowd window 510*b*, and swing window 510*c* include position lines 515*a*, 515*b*, and 515*c*, respectively, that plot resolver position versus time (seconds), for the respective hoist, crowd, and swing positions of the dipper 140. Each of the hoist window 510*a*, crowd window 510*b*, and swing window 510*c* also includes an ideal end-point resolver position shown as a horizontal dashed line 520*a*, 520*b*, and 520*c*, respectively. The current positions of the hoist, crowd, and swing resolvers are the furthest-right point of each of the respective position lines 515*a*, 515*b*, and 515*c*, which are highlighted with a window 525*a*, 525*b*, and 525*c*, respectively. In some embodiments, the ideal path for each of the hoist, crowd, and swing motions are also depicted on the hoist, crowd, and swing windows 510*a-c*, respectively.

The hoist window 510*a*, crowd window 510*b*, and swing window 510*c* each use the same time scale and make the current time position easily identifiable to the operator via the windows 525*a*, 525*b*, and 525*c*. Each of the hoist window 510*a*, crowd window 510*b*, and swing window 510*c* are continuously updated as the dipper 140 is swung to the hopper 170, with the current data shifted to the left on the x-axis towards a set time horizon, while the windows 525*a*, 525*b*, and 525*c* remain static. Thus, the operator observes the desired final position of each of the hoist, crowd, and swing motions (horizontal dashed lines 520*a*, 520*b*, and 520*c*), the past position data for each of the hoist, crowd, and swing motions (the position lines 515*a*, 515*b*, and 515*c* to the left of the windows 525*a*, 525*b*, and 525*c*, respectively), and the current hoist, crowd, and swing position of the dipper 140 as highlighted by the windows 525*a*, 525*b*, 525*c*.

In some embodiments, the position lines 515*a*, 515*c*, and 515*c* are in a first color (e.g., green), the windows 525*a*, 525*b*, and 525*c* are in a second color (e.g., yellow), and the horizontal dashed lines 520*a*, 520*b*, and 520*c* are in a third color (e.g., red). In some embodiments, the lines 515*a* and 520*a* within the hoist window 510*a* are a first color (e.g., green), the lines 515*b* and 520*b* within the crowd window 510*b* are a second color (e.g., blue), and the lines 515*c* and 520*c* within the swing window 510*c* are a third color (e.g., red).

Figure 9:
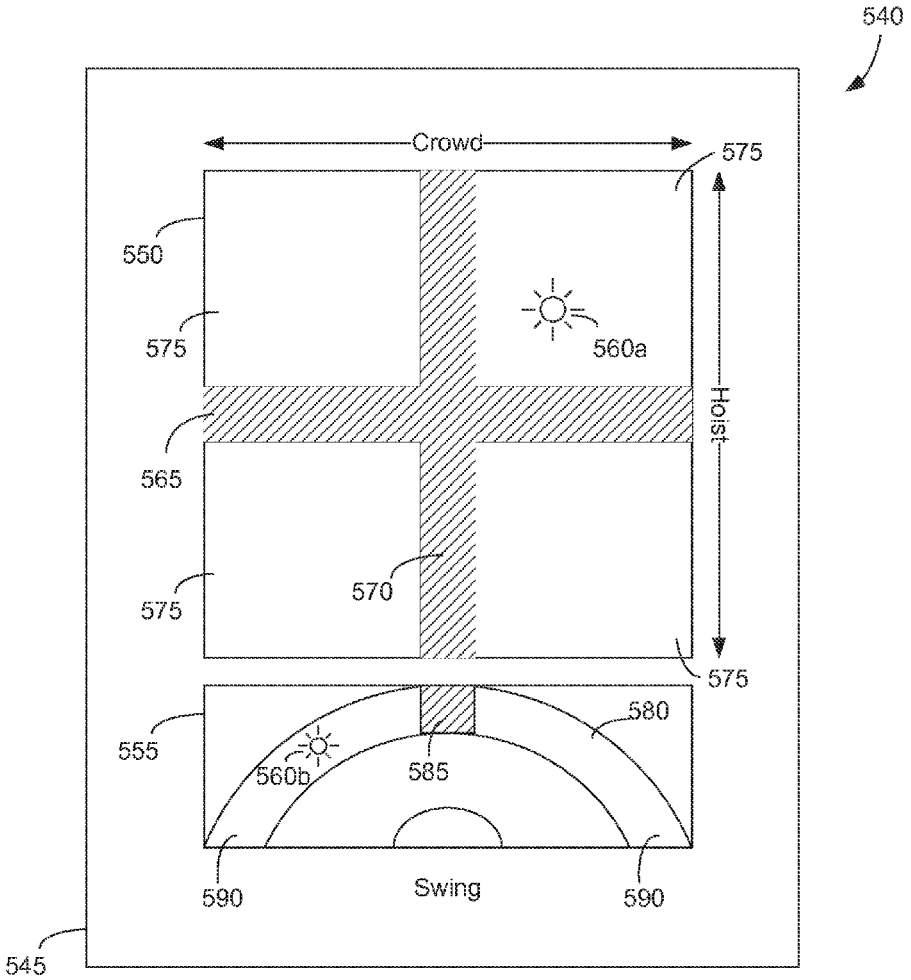

FIG. 9 depicts an LED position panel system 540 (panel system 540). In the panel system 540, the operator feedback 385 includes a display 545 with a crowd-hoist screen 550 and a swing screen 555. In the crowd-hoist screen 550, the hoist and crowd positions of the dipper 140 are conveyed as an x-y axis plot based on the resolver counts of the hoist sensors 375 and crowd sensors 365. The dipper 140 position is represented by beacon 560*a* based on the current crowd and hoist resolver counts ($CRC_t$, $HRC_t$); the desired hoist position $HRC_d$ is represented by the horizontal area 565; and the desired crowd position $CRC_d$ is represented by the vertical area 570.

As the dipper 140 is moved up and down via the hoist motor 355, the beacon 560*a* moves up and down, respectively, on the crowd-hoist screen 550 along the y-axis. As the dipper 140 is extended and retracted via the crowd motor 345, the beacon 560*a* moves left and right, respectively, on the crowd-hoist screen 550 along the x-axis. In some embodiments, the movements of the beacon 560*a* up, down, left, and right, may be reversed and/or the x- and y-axis are swapped.

The four quadrants 575 in the crowd-hoist screen 550, outside of the horizontal area 565 and vertical area 570, are illuminated red via a red LED array. The desired hoist position (horizontal area 565) and desired crowd position (vertical area 570) are illuminated green via a green LED array. The beacon 560*a* is illuminated yellow or another color that contrasts with the red and green colors of the four quadrants 575 and the desired hoist position (horizontal area 565) and desired crowd position (vertical area 570). The dipper 140 has the proper hoist and crowd position above the hopper 170 when the beacon 560*a* is at the intersection of horizontal area 565 and the vertical area 570.

In the swing screen 555, the swing position of the dipper 140 is conveyed along a position arc 580 based on the resolver count of the swing sensors 370. The swing position of the dipper 140 is represented by a beacon 560*b* and the desired swing position 585 is represented at the middle of the position arc 580. As the dipper 140 is swung between the dig location 220 and the hopper 170, the beacon 560*b* moves along the arc towards the desired swing position 585. The arc portions 590 that are outside of the desired swing position 585 are illuminated red via an arc of red LEDs, similar to the quadrants 575. The desired swing position 585 is illuminated green via a green LED array. Similar to the beacon 560*a*, the beacon 560*b* is yellow or another color that contrasts with red and green so as to be easily identifiable by the operator.

In some embodiments, the green LEDs of the desired hoist position (horizontal area 565), the desired crowd position (vertical area 570), and desired swing position 585 are independently illuminated once the beacons 560*a* and 560*b* reach the respective desired positions. For example, the desired swing position 585 is illuminated red or not illuminated initially; however, once the beacon 560*b* reaches the swing position 585, the swing position 585 is illuminated green to indicate to the operator that the dipper 140 is at the proper swing position above the hopper 170. Similarly, the desired hoist position (horizontal area 565) is not illuminated green until the beacon 560*a* is at the proper hoist position above the hopper 170 and the desired crowd position (vertical area 570) is not illuminated green until the beacon 560*a* is at the proper crowd position above the hopper 170. Thus, once the desired crowd position (vertical area 570), the desired hoist position (horizontal area 565), and desired swing position 585 are all illuminated green, the operator would know that the dipper 140 is in the proper position above the hopper 170 to dump its contents.

Additionally, in some embodiments, only the quadrant 575 in which the beacon 560*a* is located is illuminated red, while the other quadrants 575 are not illuminated. Similarly, the portion of the arc 580 in which the beacon 560*b* is located is illuminated red, while the portion of the arc 580 on the other side of the desired swing position 585 is not illuminated. Given the beacons 560*a* and 560*b* positions in FIG. 9, the upper right quadrant 575 would be illuminated red and the left half of the arc 590 would be illuminated red, while the rest of the crowd-hoist screen 550 and swing screen 555 would be dimmed (with the exception of the beacons 560*a* and 560*b*).

Although the display 545 is described in terms of an LED array, other display screens, such as an plasma or LCD display screen, are used in some embodiments of the invention. Additionally, other color schemes and methods to highlight the current and desired swing, crowd, and hoist positions on the display 545 are contemplated by embodiments of the invention.

Figure 10:
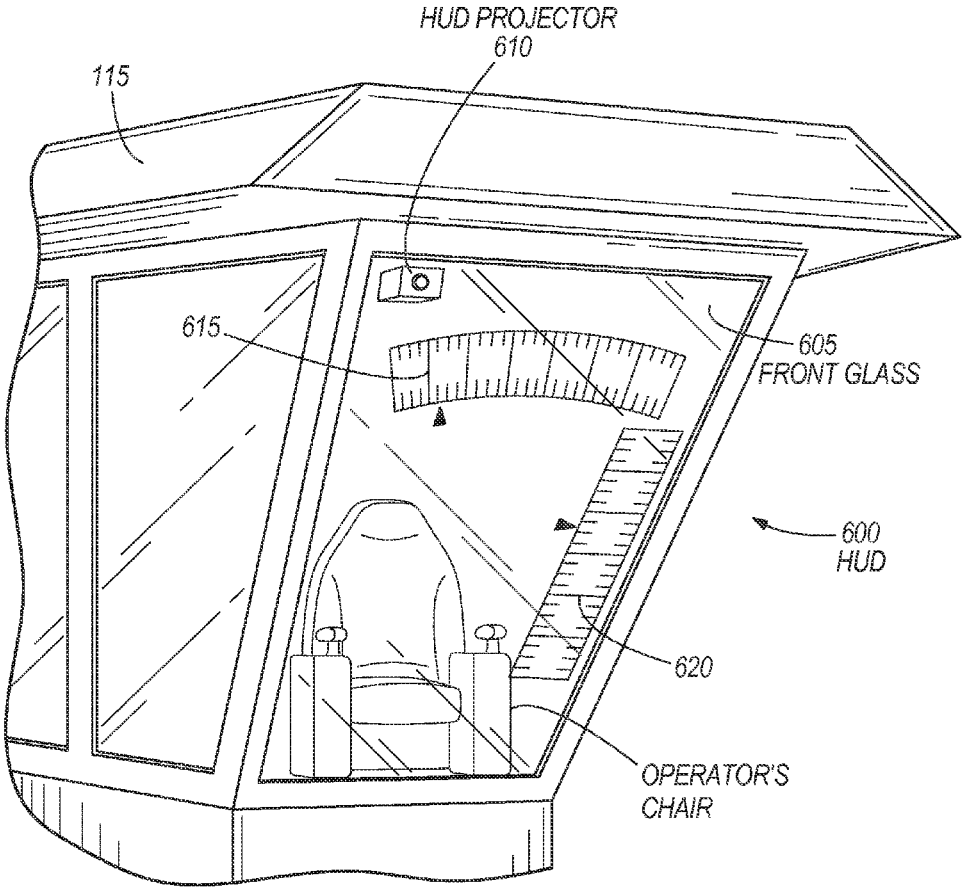

In some embodiments of the invention, the operator feedback 385 is provided in part by a heads up display (HUD) 600 as shown in FIG. 10. For instance, the HUD 600 is operable to convey the operator feedback information described in relation to the display screen 505 of FIG. 8 and the display 545 of FIG. 9. The HUD 600 enables the operator to maintain visual contact with the dipper 140 while viewing the operator feedback 385. The HUD 600 may be in addition to or in place of visual feedback systems such as the display screen 505 and display 545.

The HUD 600 is generated by projecting images on the front glass 605 of the cab 115 via a projector 610 mounted to the ceiling of the cab 115. Additional feedback related to the rope shovel 100 and crusher 175 may also be displayed on the HUD, such as additional position data, fault data, and other desired information given the operators current task.

The HUD 600 is also operable to use alternate gauge types to convey and compare the dipper 140 current position versus the desired position (e.g., above the hopper 170 or the dig location 220). As shown in FIG. 10, the HUD 600 includes a horizontal gauge 615 that represents the swing position of the dipper 140, while the vertical gauge 620 represents the crowd position and/or hoist position. In some embodiments, an additional vertical gauge is used to display the crowd or hoist position that is not shown in the vertical gauge 620.

Motion Restriction Mode

The motion restriction mode builds on the trajectory feedback mode in that it includes an ideal path generation, but it also assists the operator in moving the dipper 140 towards the hopper 170 by limiting the motion of the dipper 140. As the operator swings the dipper 140 towards the hopper 170, the controller 305 monitors the current hoist and crowd position of the dipper 140 against boundary limits of the ideal path. If operator crowd or hoist control inputs would cause the dipper 140 to deviate past a boundary limit of the ideal path, the controller 305 overrides the operator input and prevents these motions. Various embodiments of the motion restriction mode incorporated different constraint methodologies to restrict the motion of the dipper 140.

Figure 11:
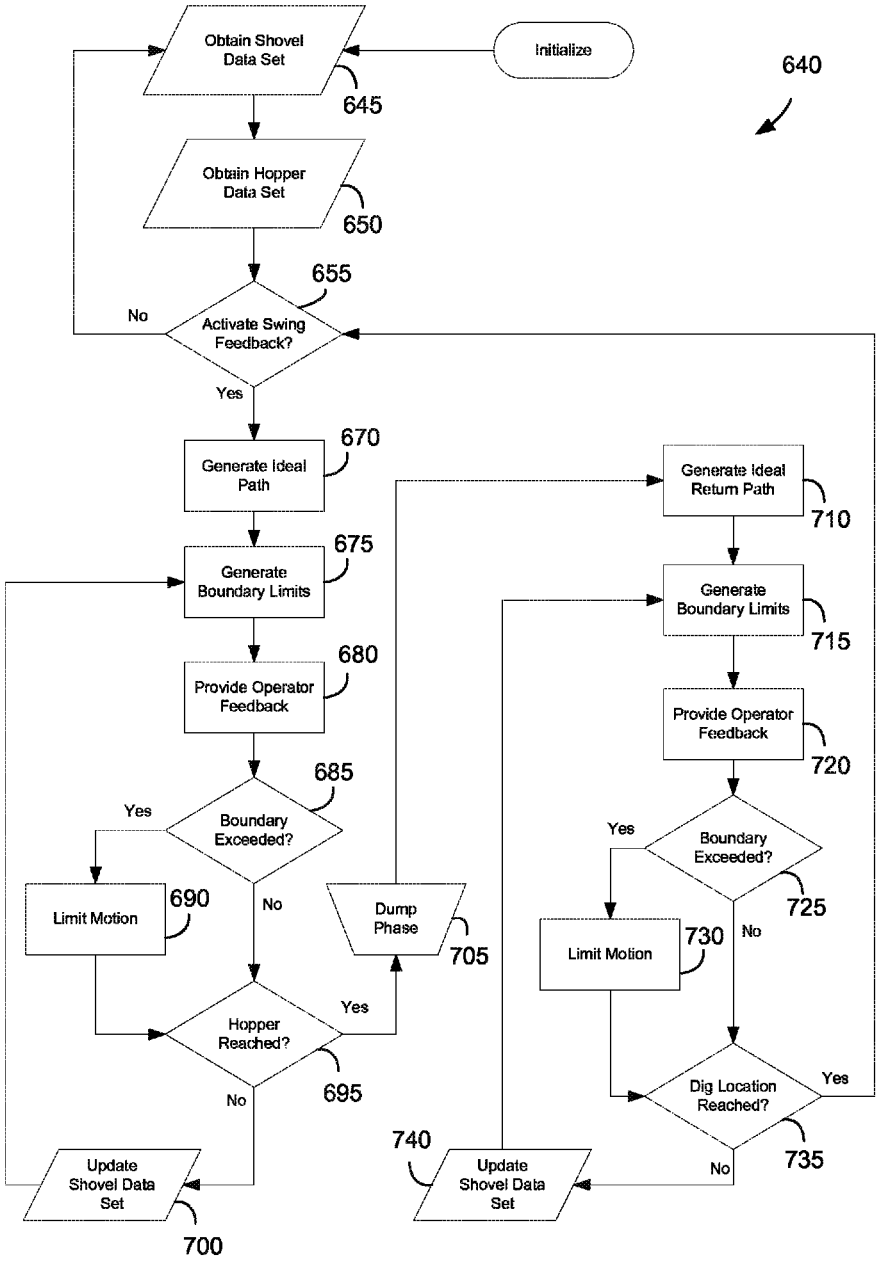
FIG. 11 depicts a method for a motion restriction mode according to embodiments of the invention.

FIG. 11 depicts a method 640 of implementing the motion restriction mode using control system 300. Similar to steps 430 and 435 of method 425 in FIG. 7, the method 640 begins by obtaining the shovel data set (see Table 1 above) and the hopper data set (see Table 2 above) in steps 645 and 650, respectively. In step 655, the controller 305 determines whether to activate motion restriction mode, which is determined in the same manner as the controller 305 evaluates step 440 of method 425. Once the motion restriction mode is entered, the controller 305 generates an ideal path to the hopper 170 and boundary limits for the ideal path in step 670. The ideal path is generated in a similar manner as described above with respect to step 445 of method 425; however, 1) the ideal path is calculated for the hoist and crowd motions, not the swing motion, and 2) the ideal path is not continuously updated, rather, the ideal path is calculated at the beginning of the swing based on the dipper 140 position at the start of the swing ($SRC_{t0}$) and the desired swing location ($SRC_d$). Calculating the ideal path without continuous updates allows applying boundary limits to a simpler, constant ideal path, reducing the complexity of the calculations in generating boundary limits. However, in some embodiments, the ideal path is continuously updated, as is done in the operator feedback mode, along with the boundary limits.

In step 675, the controller 305 generates the boundary limits for the crowd and hoist motions of the dipper 140 along the generated ideal path. Generation of the boundary limits is described in greater detail below. In step 680, the controller 305 optionally provides operator feedback as described above with respect to method 425. Thus, in addition to limiting dipper 140 motion, the motion restriction mode may also provide operator feedback to assist the operator in moving the dipper 140 between the hopper 170 and dig location 220.

In step 685, the controller 305 determines whether a crowd or hoist boundary limit generated in step 675 has been exceeded by the operator. If a crowd or hoist boundary limit has been exceeded, the controller 305 adjusts (boosts, limits, or zeros) the motion of the violating crowd or hoist motion in step 690, as appropriate, to prevent further deviation from the ideal path generated in step 670. To limit or zero crowd and/or hoist motion, the controller 305 reduces or zeros crowd and/or hoist commands to the respective hoist motor 355 and crowd motor 345. To boost the crowd and/or hoist motion, the controller 305 increases the crowd and/or hoist commands to the respective hoist motor 355 and crowd motor 345. Thereafter, if a boundary has not been exceeded, the controller 305 proceeds to step 695 to determine if the hopper 170 has been reached. If not, the controller 305 obtains an updated shovel data set in step 700. The controller 305 then returns to generate updated boundary limits in step 675. The controller 305 repeats steps 675-700 until, in step 695, the hopper 170 is reached and the dump phase is performed (step 705). In the dump phase, the operator causes the dipper door 145 to open to dump the load, e.g., by activating the door latch 360 via door control 340.

After dumping the load of the dipper 140 in step 705, the controller 305 proceeds to step 710 to generate an ideal return path back to the dig location 220. Generating an ideal return path in step 710, generating boundary limits in step 715, optionally providing operator feedback in step 720, determining whether a boundary limit is exceeded in step 725, limiting motion in step 730, determining whether the dig location 220 is reached in step 735, and updating the shovel data set in step 740 are similar to steps 670, 675, 680, 685, 690, 695, and 700, respectively, with the exception that the start and end positions of the crowd, hoist, and swing are swapped. Thus, the equations described above with respect to steps 670, 675, 680, 685, 690, 695, and 700 apply to the steps 710, 715, 720, 725, 730, 735, and 740, with the exception that $CRC_{t0}$, $HRC_{t0}$, and $SRC_{t0}$ are replaced with the corresponding crowd, hoist, and swing position of the hopper 170 and $CRC_d$, $HRC_d$, and $SRC_d$ are replaced with the corresponding crowd, hoist, and swing position of the dig location 220.

In some embodiments, the desired dig location 220 is the initial crowd, hoist, and swing position at time $t_0$ (i.e., $CRC_{t0}$, $HRC_{t0}$, and $SRC_{t0}$) used to generate the ideal path in step 670. In other embodiments, the operator stores the desired dig location 220 in the controller 305 by activating an actuator (e.g., that is part of other I/O devices 400) when the dipper 140 is at the desired dig location 220. In some embodiments, the crowd and hoist positions of a tuck position for the dipper 140 are stored as the desired crowd and hoist positions for the dig location 220. Using these tuck position values, at the completion of the swing to the dig location 220, the dipper 140 is in a tuck position and ready to begin the next dig cycle. The tuck position values for the crowd and hoist may be stored by the operator using an actuator, may be inferred by the controller based on the previous start of a dig cycle, or may be preset values (e.g., during a manufacturing process). As the dipper 140 is moved into the tuck position, gravity closes the door 145, allowing for the shovel door latch 360 to engage to keep the door closed until the next dump operation.

As noted above, in step 670, the controller 305 calculates the ideal path between the dipper 140 hoist and crowd start position ($HRC_{t0}$, $CRC_{t0}$) and the desired position ($HRC_d$, $CRC_d$). The ideal path enables a constant trajectory equation for any given swing and may be designed and modified to suit the engineering needs or customer preferences.

In some embodiments, the ideal path used by the motion restriction algorithm is a ramp equation between the dipper 140 hoist and crowd start position ($HRC_{t0}$, $CRC_{t0}$) to the desired position ($HRC_d$, $CRC_d$). A ramp equation minimizes computational cost and yields a gradual, smooth motion in hoist and crowd movements, without over-stressing the rope shovel 100. An example hoist ramp equation is $$HRC_{traj} = HRC_d + (HRC_d - HRC_{t0}) * \text{abs}\left(\frac{SRC_d - SRC_t}{SRC_d - SRC_{t0}}\right).$$

Assuming $SRC_{t0} < SRC_d$ for illustration purposes, as the operator swings the dipper 140 towards the desired swing location $SRC_d$, $SRC_t$ (current dipper 140 swing position) increases such that $HRC_{traj}$ approaches the desired hoist location $SRC_d$. In other words, when the dipper 140 reaches the desired swing location $SRC_d$, 1) $SRC_d = SRC_t$, making the ramp portion of the equation $$\left((HRC_d - HRC_{t0}) * \text{abs}\left(\frac{SRC_d - SRC_t}{SRC_d - SRC_{t0}}\right)\right)$$

become zero, and 2) the hoist trajectory $HRC_{traj}$ equals the desired hoist location $HRC_d$.

The custom trajectory equation for the crowd motion is similar, with $$CRC_{traj} = CRC_d + (CRC_d - CRC_{t0}) * \text{abs}\left(\frac{SRC_d - SRC_t}{SRC_d - SRC_{t0}}\right).$$

These equations can be modified and changed to match a variety of desired trajectories. For instance, the ideal path may use a polynomial curve, it may change the time when the desired location is achieved (e.g., such that the hoist is at the desired hoist location before the dipper 140 reaches the desired swing position), it may specify desired enter/exit velocities, or include other customizations.

To generate boundary limits for the motion of the dipper 140, a motion restriction algorithm is also evaluated in step 675. The motion restriction algorithm prevents the operator from excessively deviating from the desired trajectories of the swing and crowd motions. The motion restriction algorithm is used to adjust (boost, limit, or zero) the speed of the crowd and/or hoist motions once an upper or lower limit is exceeded. As an example, if the operator attempts to hoist the dipper 140 too high above the hopper 170 such that the dipper 140 would exceed the upper limit when near the hopper 170, the controller 305 would zero the hoist speed reference command sent to the hoist motor 355 (preventing further raising of the dipper 140 via the hoist motor 355). The upper and lower limits of the hoist and crowd motions are established using a variety of constraint equations. The boundary limits are applied to the ideal path and are continuously updated as the operator moves the dipper 140 towards or away from the desired swing position $SRC_d$.

A ramp constraint equation is one type of constraint equation used by method 640. The ramp constraint equation includes a start and end limit, and the slope of the ramp is scaled dependant on the total swing distance (abs($SRC_d - SRC_{t0}$)) to the desired swing position $SRC_d$. For illustration purposes, a ramp constraint equation for the hoist motion is:

$$HRC_{lim} = m_r * \text{abs}\left(\frac{SRC_d - SRC_t}{SRC_d - SRC_{t0}}\right) + c_r,$$

where $m_r$ is the starting position of the ramp slope in hoist resolver counts, and $c_r$ is the end position of the ramp slope in hoist resolver counts. $HRC_{boundary}$ is then calculated based on $HRC_{lim}$ and $HRC_{traj}$ as follows:

$$HRC_{boundary} = HRC_{traj} \pm HRC_{lim}.$$

Figure 12:
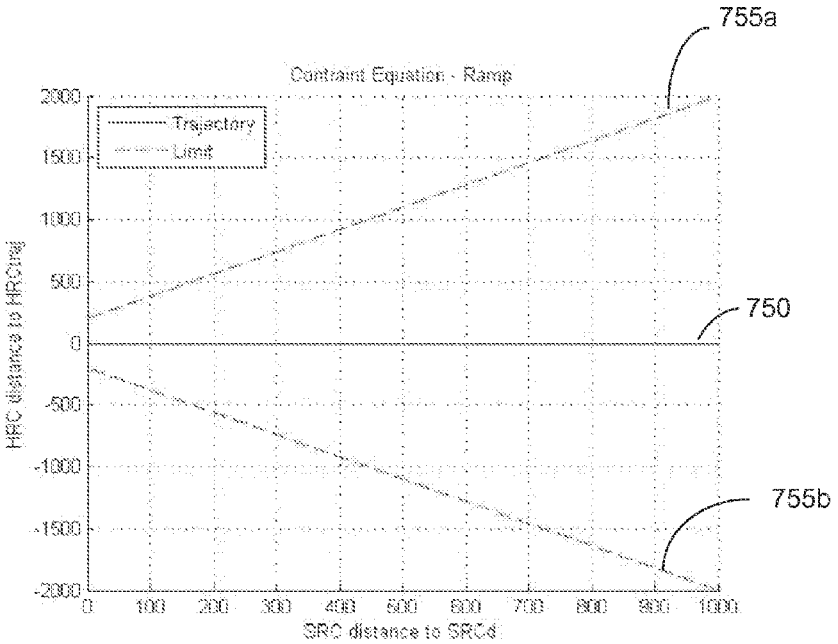
FIGS. 12-20 depict various ideal paths and motion restriction boundary limits according to embodiments of the invention.

FIG. 12 illustrates a hoist boundary based on a ramp constraint equation and a constant ideal path (equal to zero) with $m_r$ set to 1800 counts and $c_r$ set to 200 counts. The x-axis represents the swing distance, in swing resolver counts, to the desired swing position ($SRC_d$), while the y-axis represents the hoist distance, in hoist resolver counts, to the hoist ideal path. The hoist ideal path 750 is shown as a straight line; and the upper hoist boundary 755*a* and lower hoist boundary 755*b* are shown as dashed lines.

Figure 13:
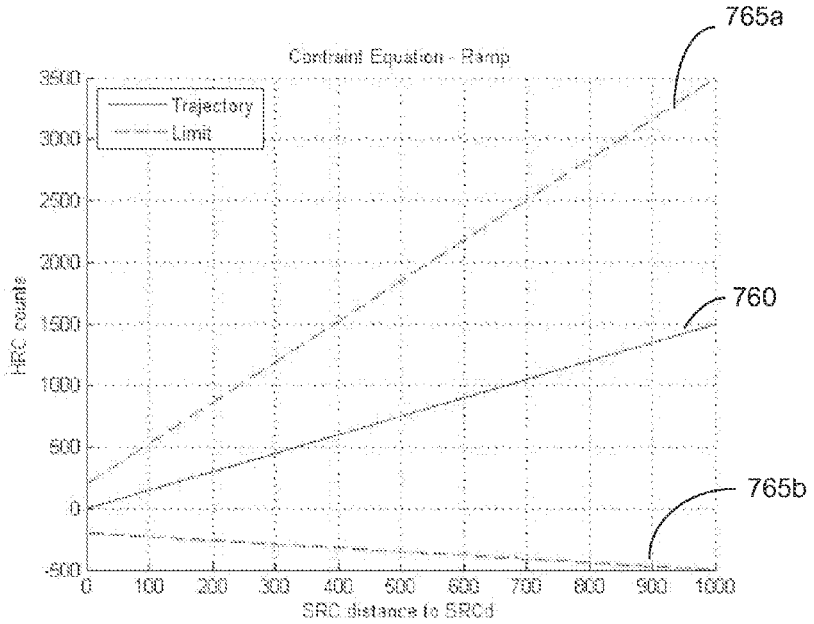

The hoist trajectory ($HRC_{traj}$) equation noted above is dependent on the swing motion. FIG. 13 illustrates the hoist trajectory ($HRC_{traj}$) with a starting hoist position of 1500 counts and an end hoist position of zero counts, and depicts how the boundary limits are effected by the hoist trajectory. The hoist ideal path 760 is shown as a solid, straight line; and the upper hoist boundary 765*a* and lower hoist boundary 765*b* are shown as dashed, straight lines.

Figure 14:
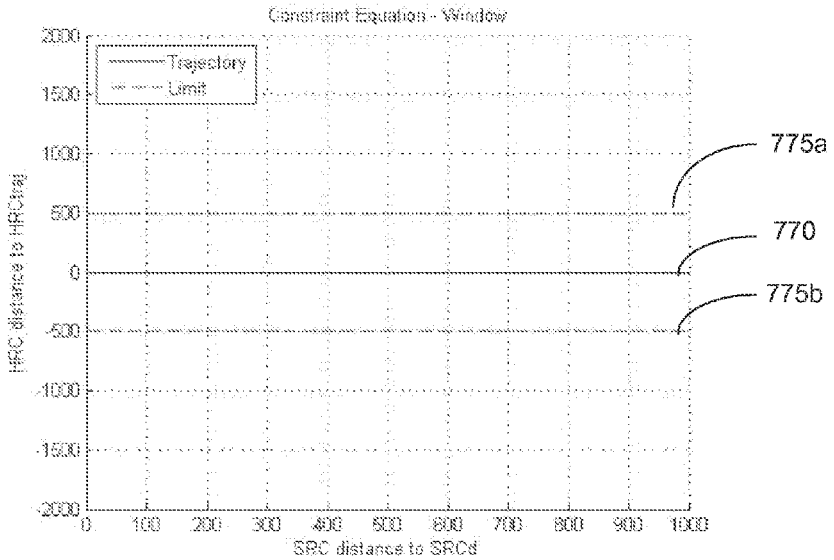
Figure 15:
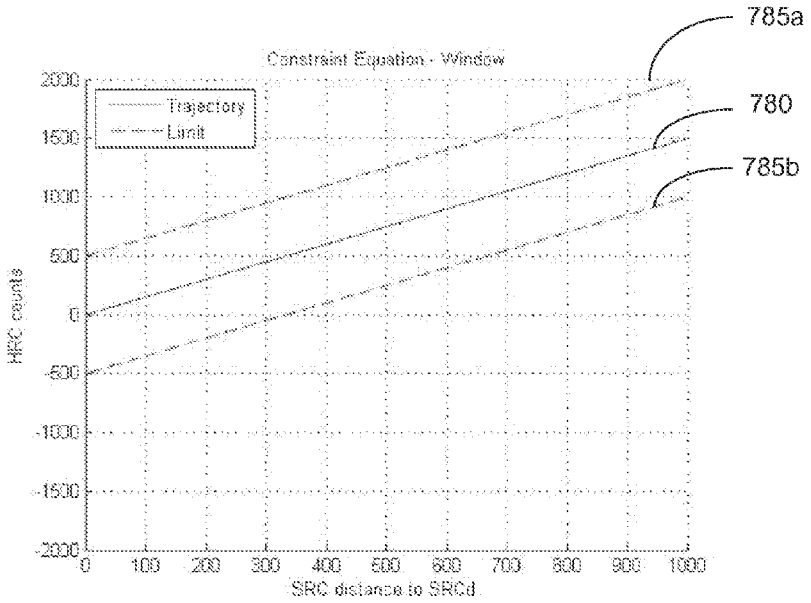

An alternative constraint equation is a constant constraint equation that is a static window. For instance, the boundary equation remains $HRC_{boundary}=HRC_{traj}\pm HRC_{lim}$, however, $HRC_{lim}$ is set to a constant value $c_w$ (i.e., $HRC_{lim}=c_w$), where $c_w$ indicates the size of the static window about the ideal path. FIG. 14 illustrates a constant constraint equation with $c_w$ set to 500 hoist resolver counts. The hoist ideal path 770 is shown as a straight line; and the upper hoist boundary 775*a* and lower hoist boundary 775*b* are shown as dashed lines. FIG. 15 illustrates the static window constraint as a function of a changing hoist trajectory, which changes over the course of the swing to the hopper 170. In FIG. 15, the hoist ideal path 780 is shown as a solid, straight line; and the upper hoist boundary 785*a* and lower hoist boundary 785*b* are shown as dashed, straight lines.

An alternative constraint equation is a polynomial curve. The polynomial curve is based on establishing a characteristic equation and solving a series of coefficients that are dependant on the hoist and crowd start position, desired position, and desired velocities. The limit equation is a third-order polynomial:

$$HRC_{lim}=a_0+a_1*SRC_t+a_2*SRC_2^2+SRC_t^3.$$

The coefficients are solved for each swing phase due to the dependencies of where the operator started to swing.

$$\begin{bmatrix} 1 & SRC_{t0} & SRC_{to}^2 & SRC_{t0}^3 \\ 0 & 1 & 2*SRC_{t0} & 3*SRC_{t0}^2 \\ 1 & SRC_d & SRC_d^2 & SRC_d^3 \\ 0 & 1 & 2*SRC_d & 3*SRC_d^2 \end{bmatrix} \begin{bmatrix} a_0 \\ a_1 \\ a_2 \\ a_3 \end{bmatrix} = \begin{bmatrix} HRC_{t0} \\ H\dot{R}C_{t0} \\ HRC_d \\ H\dot{R}C_d \end{bmatrix}$$

Figure 16:
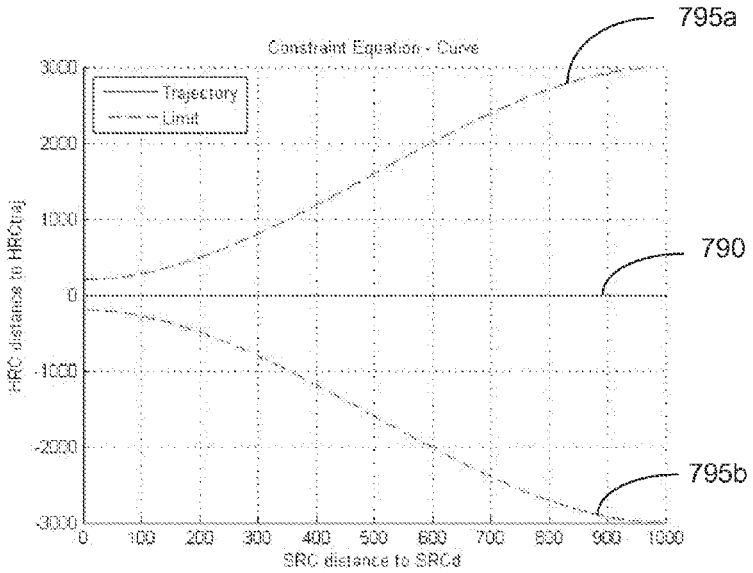

The initial and desired hoist resolver velocities ($H\dot{R}C_{t0}$ and $H\dot{R}C_d$) can be changed to augment the polynomial curve allowing for some degree of customization. FIG. 16 depicts the polynomial curve with the hoist resolver velocities set to zero. In FIG. 16, the hoist ideal path 750 is shown as a straight line; and the upper hoist boundary 755*a* and lower hoist boundary 755*b* are shown as dashed lines.

Figure 17:
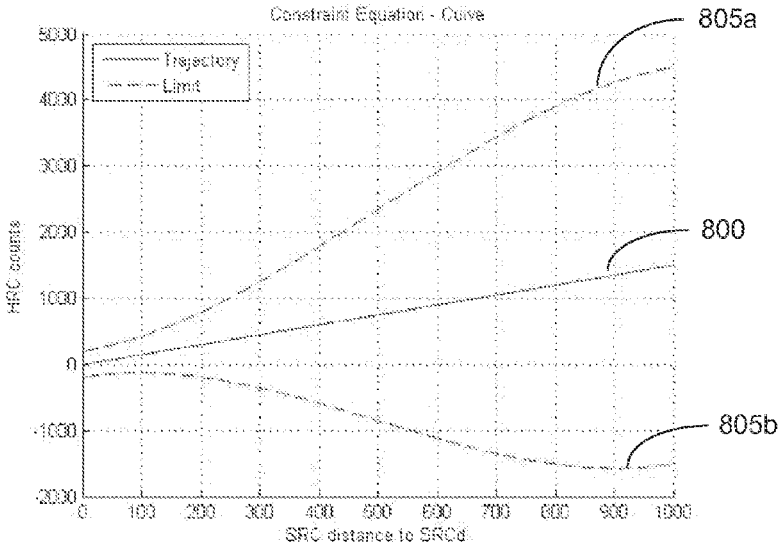
Figure 18:
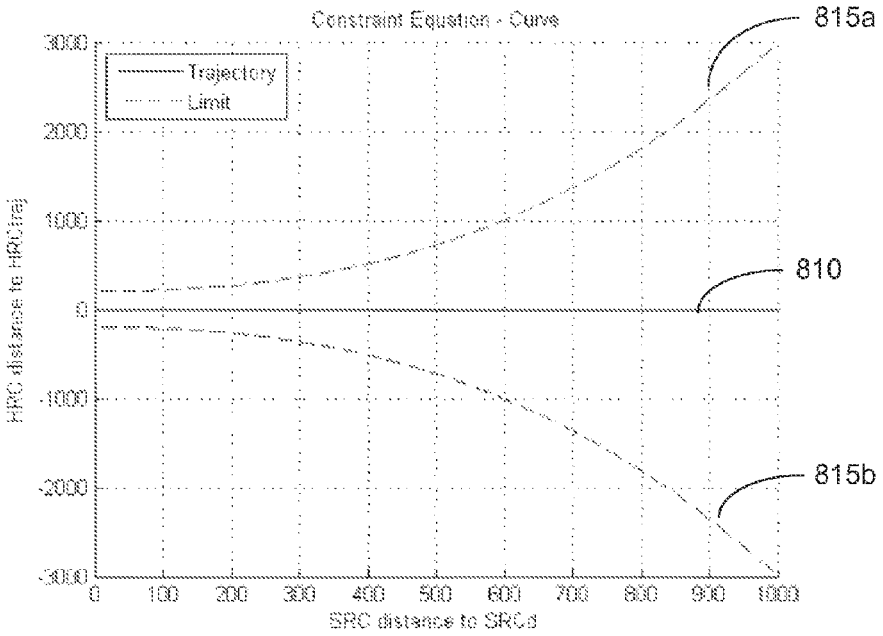

FIG. 17 depicts the polynomial curve as a function of the hoist trajectory, with the hoist ideal path 800 shown as a straight line and the upper hoist boundary 805*a* and lower hoist boundary 805*b* shown as dashed lines. Changing the hoist resolver velocity causes the polynomial curves to change how the curve moves from start to finish. Varying the hoist resolver velocity enables the controlling of the envelope of the curve. For example, FIG. 18 depicts ideal path 810 with boundary limits 815*a* and 815*b*, which are based on a polynomial curve with the starting hoist resolver velocity was set to a non-zero value. Therefore, the boundary limits 815*a* and 815*b* have a bell-shaped curve with a longer neck (narrow end), which requires the operator to get the dipper 140 closer to the ideal path 810 sooner.

Figure 19:
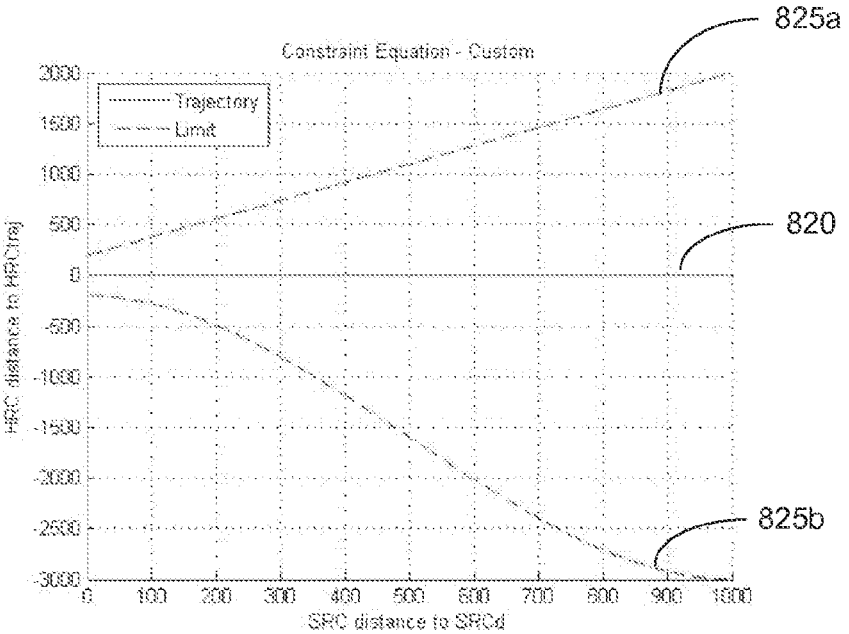
Figure 20:
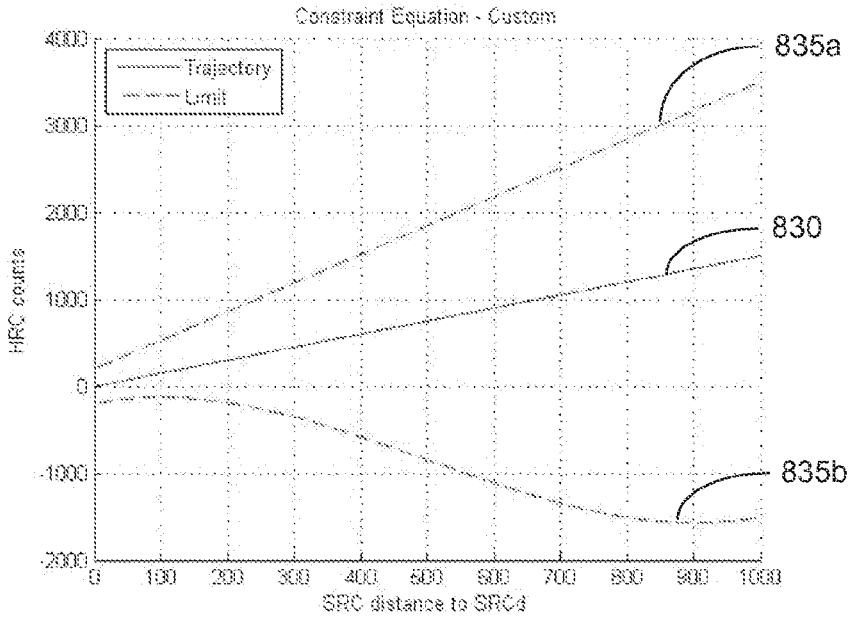

Additional constraint equations may also be used. For instance, the controller 305 may implement different constraint equations for the upper and lower boundaries (see, e.g., FIGS. 19 and 20), or use a polynomial blended by various position constraints. FIGS. 19 and 20 depict ideal paths 820 and 830 with upper boundaries 825*a* and 835*a* implemented as ramp constraints and lower boundaries 825*b* and 835*b* implemented as polynomial curves. A polynomial blend includes establishing different position constraints to set up key points, and then developing a constraint equation that meets all the key points. For example, a $2^{nd}$ order polynomial fit would yield an equation that passes through three key points. The more key points used, the more complex the polynomial would be (e.g. sinusoidal fit to multiple points). To reduce the complexity of multiple key points, while conceding some accuracy, the controller 305 may also implement a least-squares fit to the key points.

Teach Mode

Figure 21:
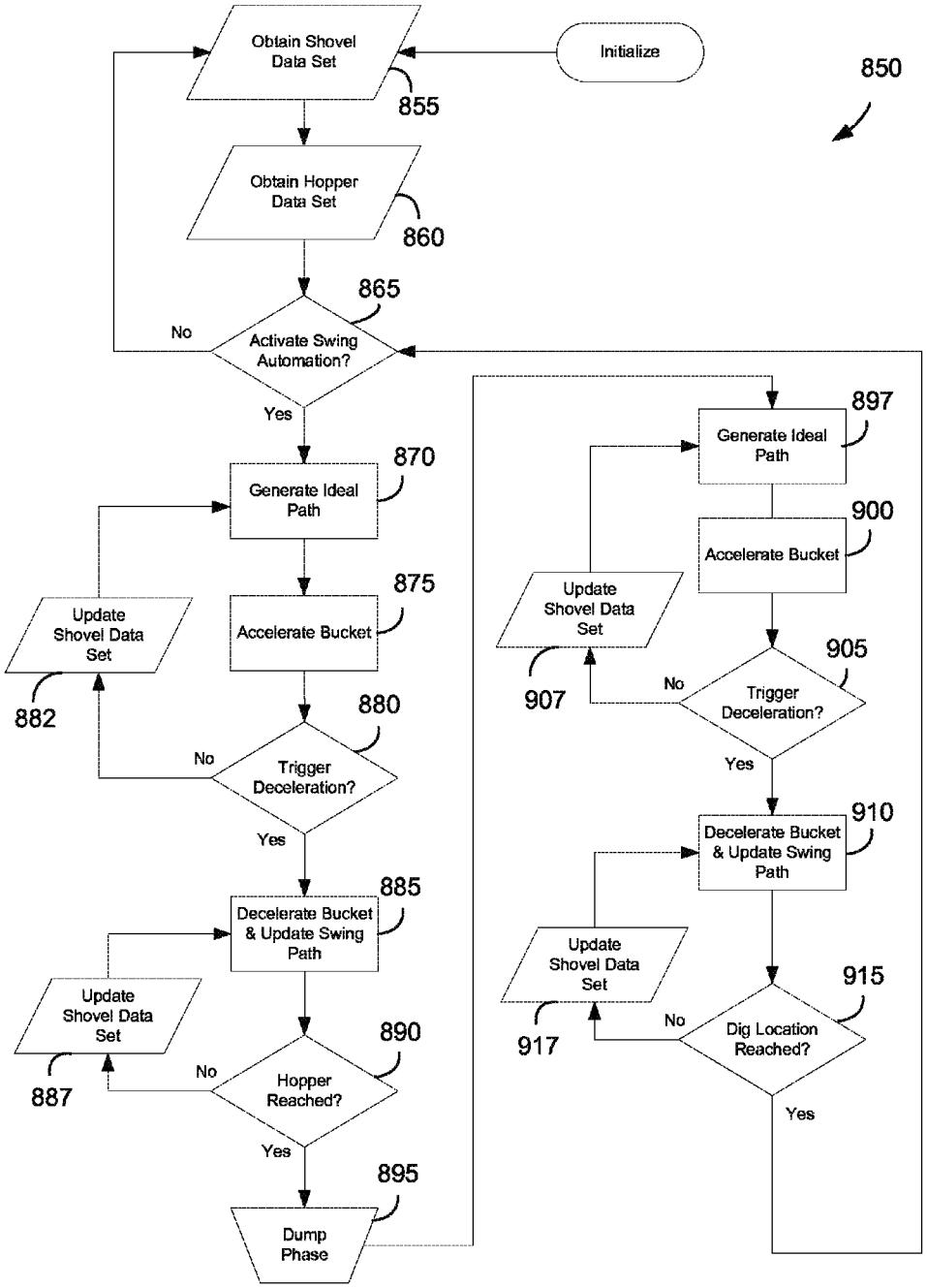
FIG. 21 depicts a method for a teach mode according to embodiments of the invention.

In the teach mode, 1) the operator "teaches" the controller 305 the desired end position of the dipper 140 (e.g., over the hopper 170) and the start position of the dipper 140 (the dig location 220), 2) the controller 305 generates an ideal path, and 3) the controller 305 automatically controls the swing-to-hopper motion of the dipper 140. FIG. 21 illustrates a method 850 for implementing the teach mode with the control system 300. Similar to methods 425 and 640, the teach mode method 850 begins by obtaining the shovel data set (step 855) and hopper data set (step 860). In some embodiments of the teach mode method 850, the controller 305 obtains additional data for the shovel data set and hopper data set including: a boolean swing automation trigger; a shovel front-back house inclinometer; a shovel right-left house inclinometer; a Boolean desired dump position trigger; a hopper front-back house inclinometer, and a hopper right-left house inclinometer.

To teach the controller 305, the operator may manually enter the end position and start position by moving the dipper 140 to the appropriate position and triggering a store operation, which stores the swing, crowd, and hoist resolver counts in the controller 305. For instance, the operator may trigger the store operation by changing the desired dump position trigger to be true. The operator changes the desired dump position trigger to be true by depressing a joystick button, depressing foot pedals and/or horn triggers in a particular manner, and/or via input to a graphical user interface (GUI). In some embodiments, the controller 305 is operable to automatically detect the desired end position and start position. For instance, the controller 305 may automatically detect the desired end position by storing the swing, crowd, and hoist resolver counts upon a dump operation (i.e., releasing door 145 of the dipper 140). Additionally, the controller 305 may automatically detect the start position of the dipper 140 by noting the swing, crowd, and hoist resolver counts upon completion of a dig cycle.

Figure 22:
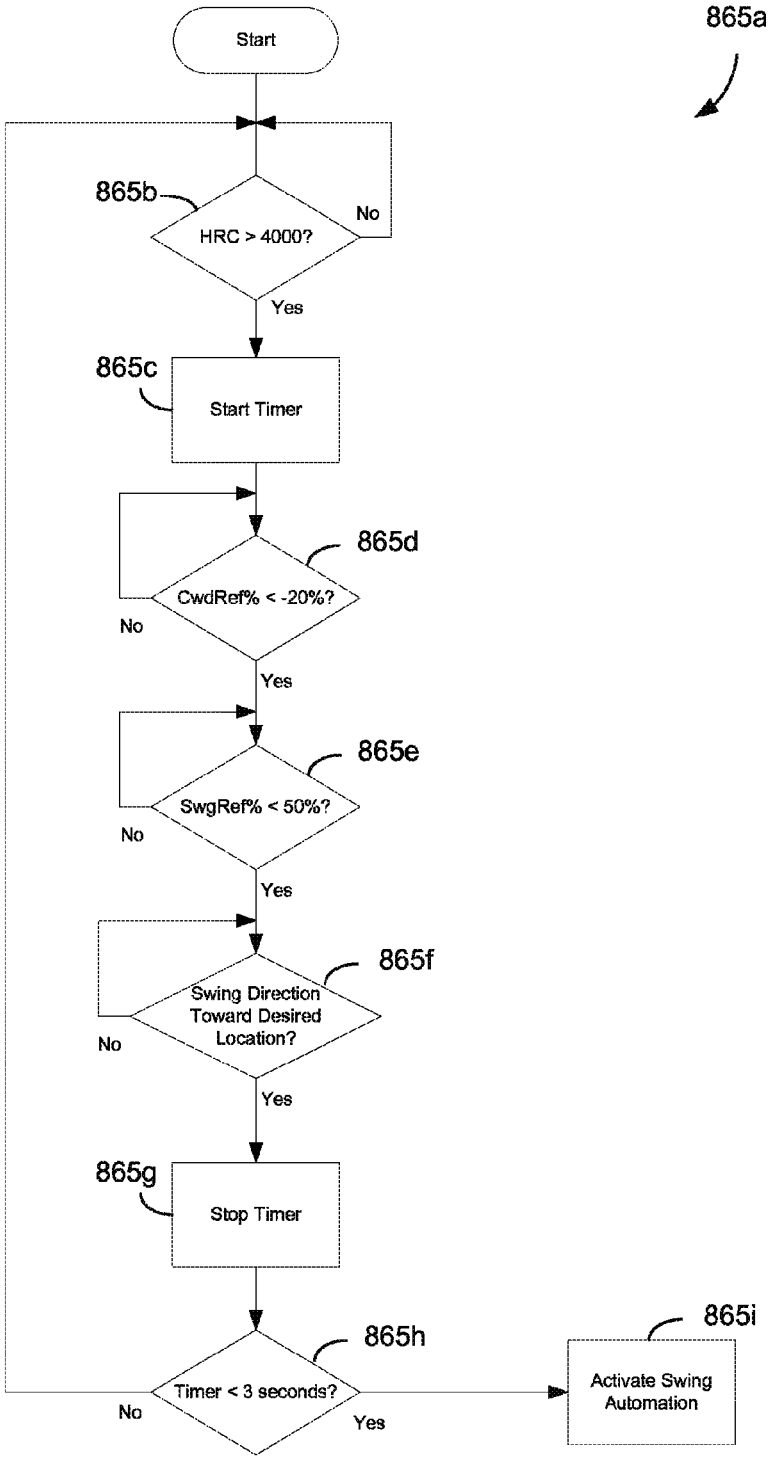
FIG. 22 depicts a method for detecting a swing-to-hopper motion according to embodiments of the invention.

In step 865, the controller determines whether the dipper 140 is clear of a bank at the dig location 220 and the swing automation has been activated. In some embodiments, the operator manually actuates a swing automation button (e.g., via other I/O devices 400) to activate swing automation. In other embodiments, the controller 305 automatically detects that the operator is retracting away from the bank and has begun to swing towards the desired dump position (i.e., the hopper 170). For instance, FIG. 22 illustrates method 865*a*, which is step 865 implemented with automatic swing-to-hopper detection. In step 865*b*, the controller 305 determines whether the resolver count of the hoist (HRC) is greater than a present value (e.g., 4000). If HRC is greater than preset value, the controller 305 starts a timer (step 856*b*). The timer continues until the conditions of steps 865*d*, 865*e*, and 865*f* are true. The controller 305 determines the condition of step 865*d* is true when the operator has input crowd commands (via crowd control 325) to retract the crowd at a rate greater than 20% of the maximum crowd retract command. The controller 305 determines the condition of step 865*e* is true when the operator has input swing commands (via swing control 330) to swing the dipper 140 at a rate greater than 50% of the maximum swing command. The controller 305 determines the condition of step 865*f* is true if the operator has input swing commands (via swing control 330) to swing the dipper 140 towards the hopper 170.

Once conditions of step 865*d*, 865*e*, and 865*f* are evaluated to be true, the controller 305 stops the timer started in step 865*c* (step 865*g*). In step 865*h*, the controller determines if the elapsed time between the start and stop of the timer is less than a predetermined value (e.g., three seconds). If so, the controller 305 determines that the operator has begun a swing-to-hopper motion (step 865*i*) and evaluates step 865 (of FIG. 21) to be true.

In some embodiments, the automatic swing-to-hopper detection of FIG. 22 is implemented in addition to a manual swing automation button. In the combined system, the manual swing automation button indicates to the controller 305 that swing automation has been activated (in step 865) regardless of the status of the automated method depicted in FIG. 22.

After determining the swing automation has been activated in step 865, the controller 305 proceeds to generate an ideal path for the dipper 140 to the hopper 170 (step 870). In the teach method, the ideal path for the swing motion of the dipper 140 is calculated in the same manner as described above with respect to the operator feedback mode. That is, the controller estimates the total swing resolver counts needed to stop the dipper 140 above the hopper 170 ($\Delta SRC_{decel}$) based on current dipper swing speed (SRC) and swing resolver counts remaining to arrive at the hopper 170 ($SRC_{rem}$). As the dipper 140 is swung, $\Delta SRC_{decel}$ eventually becomes equal to the current swing resolver count position ($SRC_t$) less the desired swing resolver count ($SRC_d$), which signals to the controller 305 to start decelerating the dipper swing motion. The swing motion is continuously monitored with $\Delta SRC_{decel}$ and $SRC_{rem}$ being continuously updated as the dipper 140 is swung to the hopper 170, which ensures that the continuously calculated ideal path remains accurate.

In the teach mode, however, the ideal paths for the hoist and crowd motions are calculated as done in the motion restriction mode. That is, the ideal paths for the hoist and crowd, $HRC_{traj}$ and $CRC_{traj}$, respectively, are calculated as follows:

$$HRC_{traj} = HRC_d + (HRC_d - HRC_{t0}) * \text{abs}\left(\frac{SRC_d - SRC_t}{SRC_d - SRC_{t0}}\right)$$

$$CRC_{traj} = CRC_d + (CRC_d - CRC_{t0}) * \text{abs}\left(\frac{SRC_d - SRC_t}{SRC_d - SRC_{t0}}\right)$$

Once the ideal paths for the hoist, crowd, and swing motions are generated, the controller 305 proceeds to actively and automatically control the dipper 140 without the need for operator input (e.g., via operator controls 320). In step 875, the controller 305 accelerates the swing motion of the dipper 140 towards the hopper 170 according to the ideal path generated in step 870. Simultaneously, the controller 305 begins controlling the hoist and crowd motions according to the ideal paths generated in step 870. In step 880, the controller 305 determines whether the dipper 140 has reached the point along the ideal swing path where the controller 305 is to begin deceleration. If not, the controller 305 updates the shovel data set in step 882 before returning to step 870. In step 870, the controller 305 updates the ideal swing path, but maintains the previously generated ideal paths for the hoist and crowd motions.

The controller 305 cycles through steps 870, 875, 880, and 882 until the controller 305 determines in step 880 that the dipper 140 is to be decelerated (based on the ideal swing path). The controller 305 proceeds to step 885 and decelerates the swing motion of the dipper 140 along the ideal swing path and continues to control the hoist and crowd motions along their respective ideal paths. The controller 305 also continues to update the shovel data set in step 887 and update the ideal swing path in step 885 until, in step 890, the dipper 140 is stopped above the hopper 170. The controller 305 proceeds to dump the contents of the dipper 140 in step 895. In some embodiments, the controller 305 cannot dump the load without operator input (e.g., to confirm the dipper 140 is above the hopper 170).

After dumping the load of the dipper 140 in step 895, the controller 305 awaits a determination that the operator desires to swing the dipper 140 back to the dig location 220 similar to how step 865 determines a swing-to-hopper motion is desired (e.g., the operator depresses a swing automation button). Once the controller 305 determines that the operator desires to swing the dipper 140 to the dig location 220, the controller 305 proceeds to step 897 to generate an ideal return path back to the dig location 220.

Generating an ideal return path in step 897, accelerating the dipper 140 in step 900, determining whether to begin decelerating the dipper 140 in step 905, updating the shovel data set in step 907, decelerating the dipper 140 and updating the ideal swing path in step 910, determining whether the dig location is reached in step 915, and updated the shovel data set in step 917 are similar to steps 870, 875, 880, 882, 885, 890, and 887 respectively, with the exception that the start and end positions of the crowd, hoist, and swing are swapped. Thus, the equations described above with respect to steps 870, 875, 880, 882, 885, 890, and 887 apply to the steps 897, 900, 905, 907, 910, 915, and 917, with the exception that $CRC_{t0}$, $HRC_{t0}$, and $SRC_{t0}$ are replaced with the corresponding crowd, hoist, and swing positions of the hopper 170, and $CRC_d$, $HRC_d$, and $SRC_d$ are replaced with the corresponding crowd, hoist, and swing position of the dig location 220. In some embodiments, the desired dig location 220 is the initial crowd, hoist, and swing position at time $t_0$ (i.e., $CRC_{t0}$, $HRC_{t0}$, and $SRC_{t0}$). In other embodiments, the operator stores the desired dig location 220 in the controller 305 by activating an actuator (e.g., that is part of other I/O devices 400) when the dipper 140 is at the desired dig location 220.

In some embodiments, the crowd and hoist positions of a tuck position for the dipper 140 are stored as the desired crowd and hoist positions. Using these tuck position values, at the completion of the swing to the dig location 220, the dipper 140 is in a tuck position and ready to begin the next dig cycle. The tuck position values for the crowd and hoist may be stored by the operator using an actuator, may be inferred by the controller based on the previous start of a dig cycle, or may be preset values (e.g., during a manufacturing process). As the dipper 140 is moved into the tuck position, gravity closes the door 145, allowing for the shovel door latch 360 to engage to keep the door closed until the next dump operation.

Once the swing automation has been activated as determined in step 865, the controller 305 may exit the automated swing motion through a variety of techniques. For instance, if the rope shovel 100 or mobile mining crusher 175 is propelled, the method 850 may automatically cease or automatically control the dipper 140 to a stop (e.g., by applying reverse torque to each of the swing, crowd, and hoist motors). Alternatively, an operator may be required to keep a swing joystick or another actuator at near full-reference to continue the method 850 (e.g., a "dead man switch"). If the operator pulls away from the swing joystick or other actuator, the method 850 will stop and the dipper 140 motion will be halted.

To effect the acceleration of the dipper 140 along the ideal swing path, the controller 305 includes an acceleration controller 930 as illustrated in FIG. 23. The acceleration controller 930 becomes active in step 875, after the swing automation has begun and an ideal path is generated. A goal of the acceleration controller 930 is to provide a stable and rapid swing acceleration of the dipper 140. The stage switch 935 is initially set to receive the output from triggered step 940. The stage switch 935 forwards the output of the triggered step 940 to the swing motor 350 to accelerate the dipper 140. The swing sensors 370 output the swing motor speed to the switch 935. Once the swing motor 350 reaches a preset speed stored in the switch 935, the switch 935 switches to receive a zero output from zero source 945. Once the swing motor speed drops below the stored value in the switch 935, the switch 935 again switches to receive the output of the triggered step 940. The switch 935 switches back and forth to maintain a particular swing speed until the dipper 140 reaches the deceleration portion of the ideal swing path.

After the controller 305 determines to decelerate the swing motion of the dipper 140 (step 880), the switch 935 is set to receive the zero output from the zero source 945 and the deceleration controller 950 is activated (step 885). The deceleration controller 950 slows the swing motion of the dipper 140 such that is stops above the hopper 170. Similar to an operator's manual deceleration of dipper 140, the deceleration controller 950 pulses the torque reversal command to the swing motor 350 as the swing motion of the dipper 140 nears zero.

Initially, the deceleration controller 950 outputs via switch 955 and switch 960 a torque reversal command from triggered step 965, which is equal to or greater than the torque command from triggered step 940 in the acceleration controller 930. With the deceleration command greater than the acceleration command, the earlier assumptions made in generating the ideal swing path are maintained.

Once the swing speed drops below a threshold stored in switch 955, the switch 955 switches to receive the output of a pulse generator 970. The pulse generator 970 is designed to mimic the operator's control of the swing motion by pulsing the torque reversal command to decelerate the swing speed when the speed of the swing motor 350 nears zero. Once the swing speed drops below a lower threshold stored in switch 960, the switch 960 switches to receive the zero output of the zero source 975.

The pulse generator 970 is operable to vary the magnitude and duration of pulses to control the deceleration level of the swing motor 350. The magnitude of the pulse is dependant on the difference between the current swing speed SRC and zero, while duration of the pulse is dependant on the difference between the current swing resolver position ($SRC_t$) and the desired swing position ($SRC_d$). As the current swing speed SRC nears zero, the magnitude of the pulse is reduced. As the current swing resolver position ($SRC_t$) nears the desired swing position ($SRC_d$), the duration of the pulse is reduced. The pulsed approach enables a controlled deceleration of the dipper 140 and minimizes overshoot of the hopper 170. In some embodiments, only one of the magnitude and duration of the pulse generator 970 is varied as the dipper 140 approaches the hopper 170. The one of the magnitude and duration may be varied based on either or both of the difference between $\dot{SRC}$ and 0 or the difference between $SRC_t$ and $SRC_d$. In other embodiments, the pulse generator 970 outputs a pulse with a constant magnitude and duration.

Figure 23A:
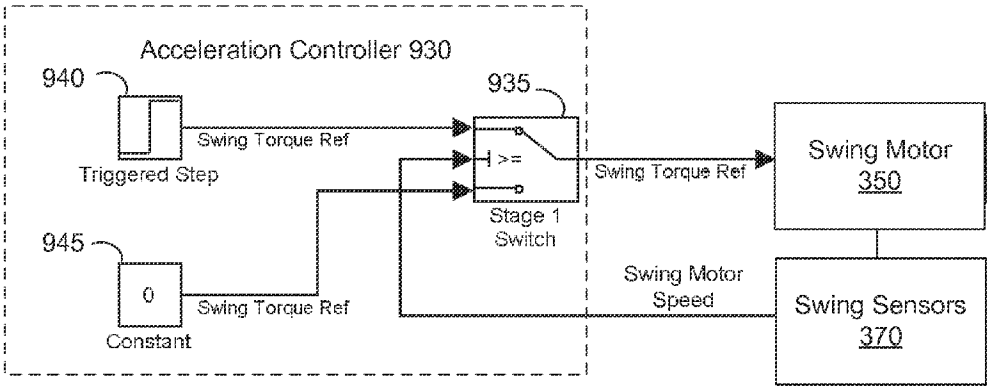
FIGS. 23A-24 depict acceleration and deceleration controllers according to embodiments of the invention.
Figure 23B:
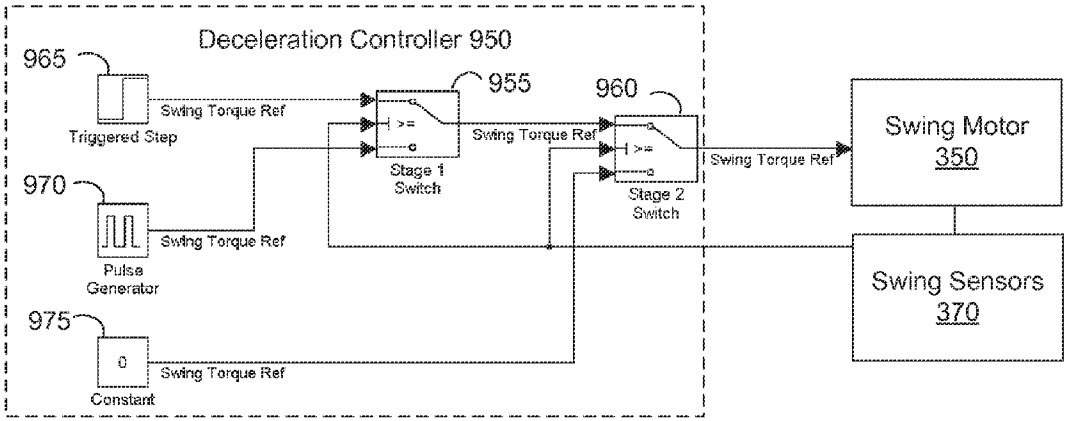
Figure 24:
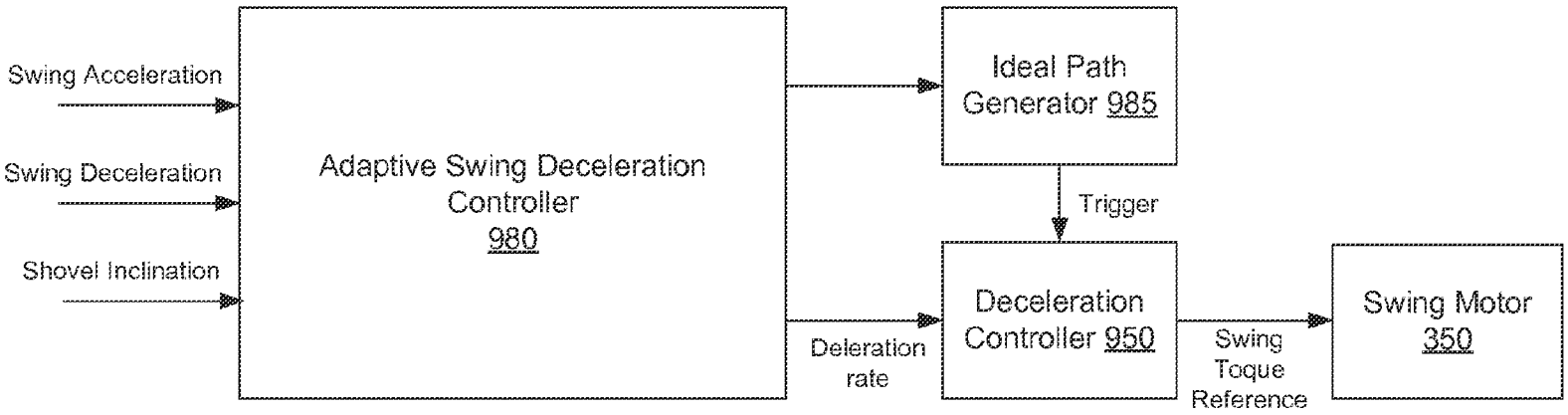

In some embodiments, an adaptive deceleration controller 980 is included in the controller 305 in addition to the acceleration controller 930 and deceleration controller 950 of FIGS. 23A-B. Initially, the adaptive deceleration controller 980 does not alter the deceleration of the dipper 140 as described above. That is, initially, the deceleration rate is assumed to be approximately equal to the acceleration rate. Over the course of multiple swings, the adaptive deceleration controller 980 monitors actual acceleration and deceleration of the dipper 140. Based on the monitoring, the deceleration controller 980 estimates a more accurate relationship between the acceleration and deceleration rate. For instance, as shown in FIG. 24, the adaptive deceleration controller 980 receives the actual acceleration rate and deceleration rate of the dipper 140 (e.g., from swing sensors 370). In other embodiments, the adaptive deceleration controller 980 calculates the acceleration and deceleration rates based on speed or position data received from swing sensors 370.

Based on monitored swings to the hopper 170, the adaptive deceleration controller 980 generates a coefficient $k_{adapt}$ to adjust the swing deceleration rate according to the following equation: $\ddot{\theta}_{swing_decel}=k_{adapt}*\ddot{\theta}_{swing_accel}$ Initially, $k_{adapt}$ is set to one. If, based on the monitored swings, the adaptive deceleration controller 980 determines that the deceleration rate is too aggressive and the dipper 140 is decelerating unnecessarily fast (reducing overall efficiency of the rope shovel 100), the adaptive deceleration controller 980 lowers $k_{adapt}$. Conversely, if the deceleration rate is not aggressive enough, $k_{adapt}$ is increased. Once the rope shovel 100 propels, $k_{adapt}$ is reset to one and the adaptive deceleration controller 980 begins monitoring again to determine if $k_{adapt}$ should be adjusted. In some embodiments, the $k_{adapt}$ does not adjust the actual deceleration rate but, rather, adjusts when the deceleration is triggered (i.e., when step 880 is evaluated as true).

The adaptive deceleration controller 980 also receives the shovel inclination data from machine house inclinometers to increase the accuracy of the predicted swing deceleration rate and to perform a sanity check to make sure the dipper 140 is not positioned in a way that the acceleration rate can overcome the deceleration rate of the swing motion. In other words, the inclinometer data enables the system to check whether the rope shovel 100 is resting at an angle (i.e., tilted with respect to the ground) such that the adaptive deceleration controller 980 is able to verify the acceleration/deceleration relationship assumption and, if necessary, alter the ideal path to compensate for variations.

In some embodiments, the controller 305 considers the mass of the load of the dipper 140 while generating ideal paths in one or more of the teach mode, operator feedback mode, and motion restriction mode. As the mass of the dipper 140 increases, the maximum acceleration and deceleration levels of the swing, hoist, and crowd motions are reduced. In some embodiments, the mass of the dipper 140 is continuously monitored. In other embodiments, to reduce complexity of the ideal path generation, a constant mass of the dipper 140 is estimated and maintained for the duration of a swing-to-hopper or return-to-dig-location motion. However, to reduce complexity further, the measured acceleration rate is used as the estimated deceleration rate, as was described with respect to the operator feedback mode above.

Full Automation Mode

In the full automation mode, the control system 300, without operator input, is operable to 1) detect the relative positions of the hopper 170 and dipper 140; 2) generate an ideal path, and 3) control the swing-to-hopper motion of the dipper 140. The previous modes infer the desired dump position either from the previous dump position or from operator feedback. The full automation mode integrates the hopper alignment system 395 to obtain the position of the hopper 170, or relative position between the hopper 170 and dipper 140, without operator input. Thus, in some embodiments, the full automation mode is similar to the teach mode, except that the operator does not teach the controller 305 the position of the hopper 170. Rather, the hopper alignment system 395 is operable to obtain and communicate to the controller 305 the desired dump position (hopper 170), without the operator needing to teach the controller 305. In other embodiments, the hopper alignment system 395 is used in the user feedback mode and/or motion restriction mode to obtain the location of the hopper 170 without user feedback or prior dumping.

Figure 25:
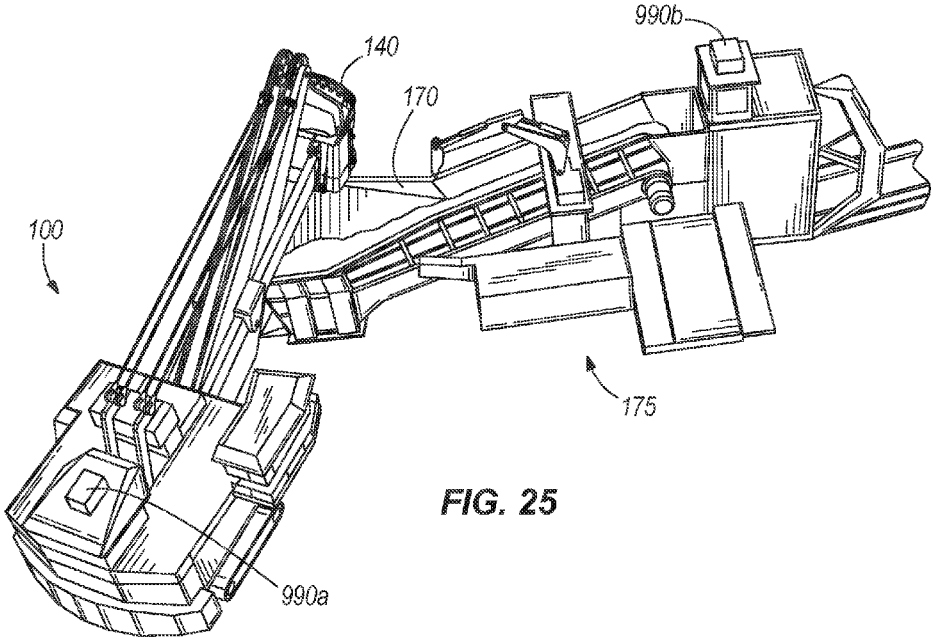
FIGS. 25, 26, 27A, and 27B depict hopper alignment systems according to embodiments of the invention.

As shown in FIG. 25, in some embodiments, the hopper alignment system 395 includes GPS units 990*a* and 990*b* positioned on the rope shovel 100 and mobile mining crusher 175, respectively. Current GPS systems are able to measure with sub-centimeter accuracy of an object's position, which is sufficient to obtain the hopper 170 and dipper 140 position for the full automation mode. The controller 305 receives the position and orientation information from the GPS units 990*a* and 990*b* of the hopper alignment system 395 and is operable to calculate the current position information of the hopper 170 and dipper 140. For instance, the controller 305 is aware of the relative offsets of the hopper 170 from the GPS unit 990*b* and relative offset of the dipper 140 from the GPS unit 990*a*. Thus, the controller 305 is able to interpret the position and orientation information from the GPS units 990*a* and 990*b* to dipper 140 and hopper 170 position information. This information is then usable in the full automation versions of methods 425, 640, and 850 described above. In some embodiments, the GPS units 990*a* and 990*b* are integrated with inertial-navigation units to improve accuracy and for measuring orientation of the hopper 170 and dipper 140.

In operation, the mobile mining crusher 175 transmits the position and orientation information from GPS unit 990*b* to the controller 305 wirelessly via a radio or mesh-wireless connection. The position and orientation information from the GPS unit 990*b* is referenced against the position of the dipper 140 to provide a desired dump position with respect to the swing axis 125. The desired dump position is transformed into a swing resolver position (SRC), which is provided to the controller 305 and used in the methods 425, 640, and 850 described above.

The desired crowd and hoist positions of dipper 140 are independent of the desired swing position and are, therefore, calculated independently. A goal is to transform a physical dump position (x, y coordinates), based on the output of the GPS unit 990*b*, into a hoist and crowd resolver count to use in the trajectory generation and motion control of the dipper 140. Three methods of calculating the desired hoist and crowd positions of the dipper 140 include using 1) a mathematical kinematic model, 2) a hoist-crowd Cartesian displacement assumption, and 3) a saddle block installed inclinometer.

A mathematical kinematic model is a vector representation of the rope shovel 100. The mathematical kinematic model uses geometric information of the various components (e.g., height of the dipper 140, length of the dipper handle 135, etc.) and understanding of the constraints on the shovel (e.g., dipper 140 connects to the dipper handle 135, the dipper handle 135 connects to the dipper shaft 130, etc.) to position the attachment (e.g., the dipper 140 and the dipper handle 135) of the rope shovel 100 as desired. The kinematic model receives data from sensors 363 (e.g., crowd, hoist, and swing resolver data) to track the position of the dipper 140 as the hoist motor 355 and crowd motor 345 rotate. The controller 305 interprets the location data from GPS unit 990*a* for the rope shovel 100 along with the kinematic model data of the rope shovel 100 to determine the desired crowd, hoist, and swing resolver counts to position the dipper 140 above the dump position (as determined based on the output of the GPS unit 990*b*).

A hoist-crowd Cartesian displacement assumption includes an assumption that the dipper 140 is at a near-horizontal crowd position and a near-vertical hoist position. With this assumption, moving the crowd is approximated as moving horizontally (x-axis motion) and moving the hoist is approximated as moving vertically (y-axis motion). Thus, the hoist-crowd Cartesian displacement assumption also includes an assumption that crowd motion only moves the dipper 140 along the x-axis and hoist motion only moves the dipper 140 along the y-axis. The controller 305 interprets the location data from GPS unit 990*a* for the rope shovel 100, along with the assumed position of the dipper 140 based on the hoist-crowd Cartesian displacement assumption, to determine the desired crowd, hoist, and swing resolver counts to position the dipper 140 above the dump position (as determined based on the output of the GPS unit 990*b*).

In a third implementation, a saddle block inclinometer is used to calculate the desired hoist and crowd positions of the dipper 140. The method includes securing a saddle block inclinometer to the handle to measure the handle angle. The controller 305 is then able to calculate the position of the dipper 140 based on the handle angle and the current crowd resolver count. The controller 305 interprets the location data from GPS unit 990*a* for the rope shovel 100, along with the determined position of the dipper 140 based on handle angle and current crowd resolver count, to determine the desired crowd, hoist, and swing resolver counts to position the dipper 140 above the dump position (as determined based on the output of the GPS unit 990*b*).

In some embodiments, the hopper alignment system 395 uses one or more optical cameras or 3-D laser scanners to implement visual or laser-based servoing. One of the above-described operation modes (e.g., trajectory feedback mode, motion restriction mode, teach mode, or full-automation mode using GPS units) is used to swing the dipper 140 within a predetermined range of the hopper 170. The predetermined range may be the range at which the optical cameras or 3-D laser scanners recognize the hopper 170 and/or dipper 140, or a particular distance (e.g., 3 meters). Once within range, the visual servoing is used to particularly align the dipper 140 in the proper position above the hopper 170 with a high degree of accuracy. In some instances, however, the full-automation mode with GPS units has a degree of accuracy that is high enough to render the visual or laser servoing unnecessary.

Figure 26:
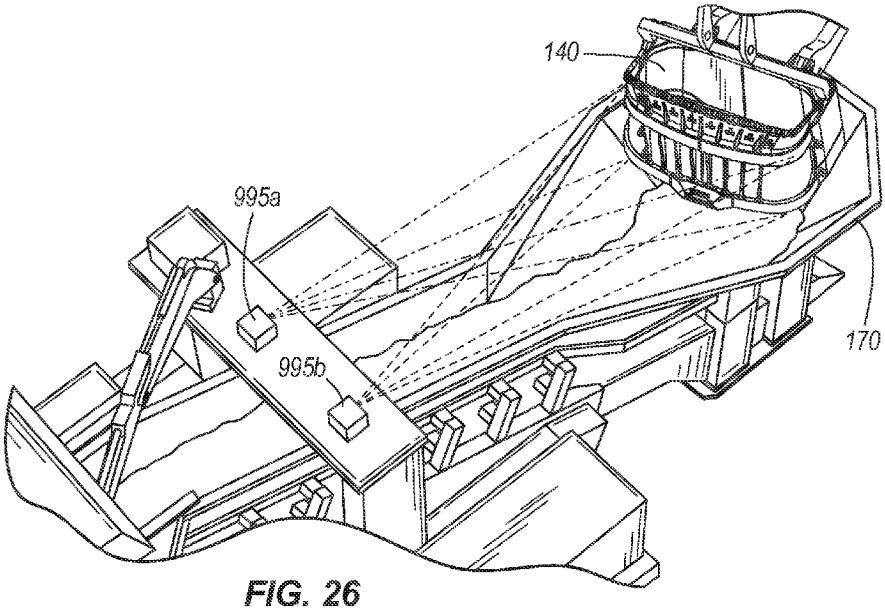

In the optical camera arrangement, visual servoing controls the dipper 140 movement based on the output of the optical cameras. FIG. 26 depicts one embodiment using two optical cameras 995*a* and 995*b* positioned in a stereoscopic arrangement on the mobile mining crusher 175 facing the hopper 170. The optical cameras 995*a* and 995*b* output data wirelessly to the controller 305 via a radio or mesh-wireless communication. The controller 305, in turn, applies correction commands to control the movement of the dipper 140.

The stereoscopic arrangement allows for a more accurate depth perception of the position of the dipper 140 relative to the hopper 170. The optical cameras 995*a* and 995*b* provide a usable controlled output with limited modeling of the base system. Each camera 995*a* and 995*b* acts like a human eye and tracks key positions on the dipper 140 (e.g., outer edges of the dipper 140). Once the dipper 140 is identified by the controller 305 via the output of the cameras 995*a* and 995*b*, the controller 305 performs trajectory calculations and identifies any control corrections to position the dipper 140 above the hopper 170.

Figure 27A:
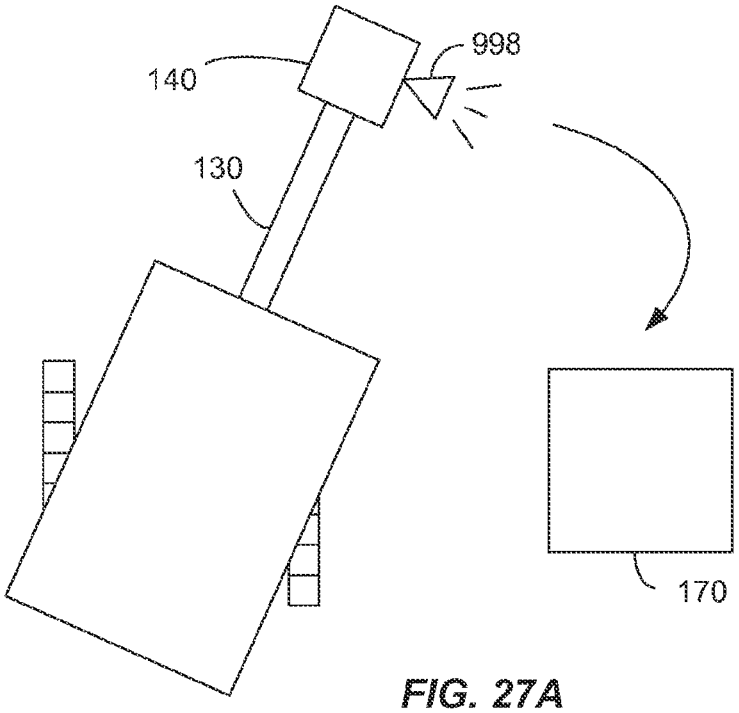
Figure 27B:
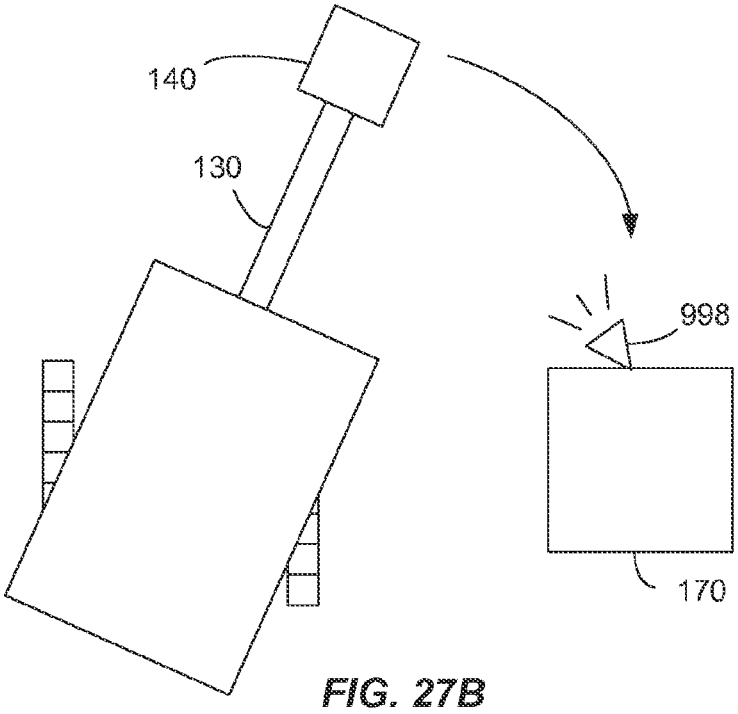

In some embodiments, a 3-D scanning laser 998 is used. The scanning laser 998*a* operates based on principles similar to those of the visual servoing system, but uses the scanning laser 998 in place of the cameras 995*a* and 995*b*. The scanning laser 998 is installed on one of the mobile mining crusher 175 (see FIG. 27A) and the rope shovel 100 (see FIG. 27B). The scanning laser 998 identifies a matrix of distances that are translated into a 3D environment around the dipper 140 and hopper 170.

When mounted on the dipper 140, the scanning laser 998 is oriented to look forward towards the mobile mining crusher 175 to identify the shape and structure of the hopper 170. The controller 305 is also designed to recognize obstacles with the scanning laser 998 along the swing path, and to avoid collisions with those obstacles by making adjustments to the crowd, hoist, and swing motion along the swing path. When mounted on the mobile mining crusher 175, the scanning laser 998 is oriented to look towards the rope shovel 100 to identify the position and orientation of the dipper 140. Like the stereoscopic camera arrangement, once the dipper 140 or hopper 170 is identified by the controller 305 via the output of the scanning laser 998, the controller 305 performs trajectory calculations and identifies any control corrections to position the dipper 140 above the hopper 170.

Figure 28:
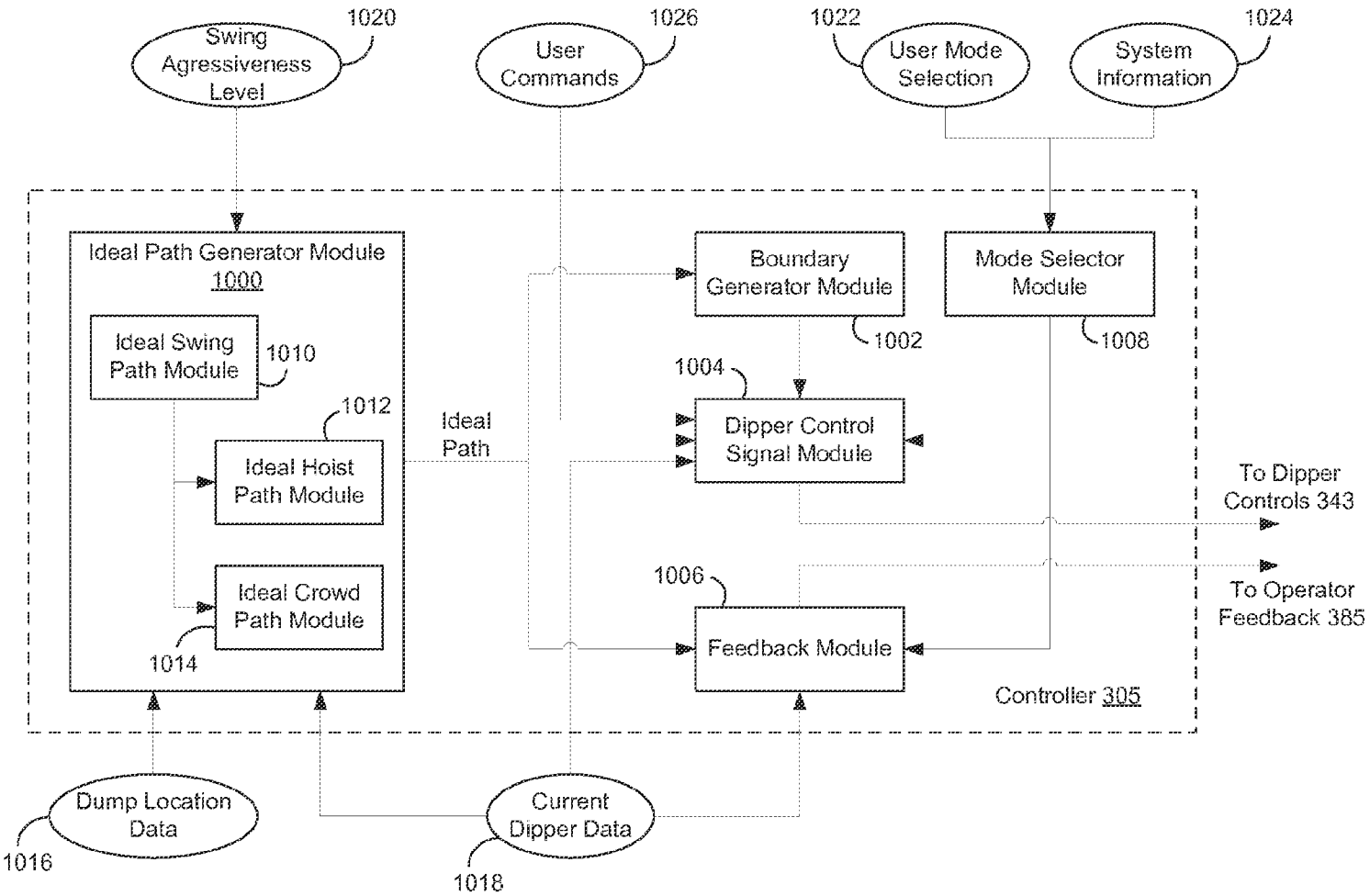
FIG. 28 illustrates the controller for swing automation according to embodiments of the invention.

FIG. 28 illustrates the controller 305 of FIG. 6 in greater detail. The controller 305 further includes an ideal path generator module 1000, a boundary generator module 1002, a dipper control signal module 1004, a feedback module 1006, and a mode selector module 1008, each of which may be implemented by one or more of the processor 310 executing instructions stored in the memory 315, an ASIC, and an FPGA. The ideal path generator module 1000 includes an ideal swing path module 1010, an ideal hoist path module 1012, and an ideal crowd path module 1014. The ideal path generator module 1000 receives dump location data 1016, current dipper data 1018, and a swing aggressiveness level 1020. The dump location data 1016 may include the hopper data set (see, e.g., step 435), or similar position information for indicating the location of another type of dump area. The current dipper data 1018 includes dipper position information, such as provided by sensors 363. The current dipper data 1018 may include the shovel data set (see, e.g., step 430).

The swing aggressiveness level may be input by an operator or other user via the other I/O 400. The swing aggressiveness level indicates the aggressiveness of the swing to be used in generating an ideal path. Generally, the more aggressive (faster) the swing, the further the limits of the shovel and, potentially, the operator are pushed. For instance, a more experienced operator may opt for a more aggressive ideal path for use in the feedback mode. Accordingly, the acceleration, top speed, and deceleration of the dipper during a swing operation may be increased. A less experienced operator, or in the case of an obstacle-prone path between the dig zone and the dump area, a less aggressive swing may be requested. Generally, a less aggressive swing exposed components of the rope shovel 100 to less mechanical wear.

The ideal path generator 1000 generates an ideal path as described above (e.g., with respect to methods 425, 640, and 850). The ideal swing path module 1010 generates an ideal swing path and provides the ideal swing path to the ideal hoist path module 1012 and the ideal crowd path module 1014. Thereafter, the ideal hoist path module 1012 and the ideal crowd path module 1014 generate an ideal hoist path and an ideal crowd path, respectively. The ideal swing, crowd, and hoist paths are output to the boundary generator module 1002, the dipper control signal module 1004, and the feedback module 1006.

The boundary generator module 1002, the dipper control signal module 1004, and the feedback module 1006 vary their operation depending on mode indicated by the mode selector module 1008. The mode selector module 1008 receives as input a user mode selection 1022 and system information 1024. The user mode selection 1022 indicates the swing automation mode that the operator would like to use to operate the rope shovel 100. For instance, the operator may use a GUI or switching device of the operator controls 320 or other I/O 400 to input a mode selection. The mode selection may be one of (a) a no swing automation mode, (b) the trajectory feedback mode; (c) the motion restriction mode; (d) the teach mode; (e) the full automation mode; and (e) a hybrid mode. The system information 1024 is also provided to the mode selector module 1008. The system information may come from, for instance, sensors 363, and other fault detection systems of the rope shovel 100. In normal operation (i.e., no faults that effect the swing automation system), the mode selector module 1008 will then indicate to the boundary generator module 1002, dipper control signal module 1004, and feedback module 1006 the selected mode.

In the no swing automation mode, the controller 305 does not implement swing automation features such as found in the trajectory feedback mode, motion restriction mode, teach mode, or full automation mode. Rather, the operator controls the rope shovel 100 normally with no swing automation assistance.

In the trajectory feedback mode, the ideal path is received by the feedback module 1006, along with the current dipper data 1018. In response, the feedback module 1006 implements the computations and processing of method 425, and outputs the controls signals to the operator feedback 385 to provide the feedback.

In the motion restriction mode, the boundary generator module 1002 receives the ideal path and generates boundaries according to one of the various techniques described above (e.g., with respect to FIGS. 12-20). The dipper control signal module 1004 receives the generated boundaries along with the user commands 1026. The user commands 1026 are the control signals from the operator controls 320 indicating the operator's desired movement of the dipper 140. The dipper control signal module 1004 determines whether a boundary is/was exceeded (e.g., step 685 of FIG. 11), and adjusts the motion of the dipper 140 accordingly (see, e.g., step 690) by outputting signals to the dipper controls 343. Also in the motion restriction mode, the feedback module 1006 may receive the ideal path and the current dipper data 1018 and provide operator feedback as performed in the feedback mode. Additionally, the feedback module 1006 may receive the generated boundaries from the boundary generator module 1002 and display the boundaries along side the ideal path to assist the operator.

In the teach mode, the operator first performs a swing and dump operation manually such that the ideal path generator module 1000 may be taught the dump location data 1016. Thereafter, the user commands 1026 may be used to indicate whether to carry-out the swing, for instance, via the dead-man switch technique noted above. The dipper control signal module 1004 then receives the ideal path from the ideal path generator module 1000. The dipper control signal module 1004 generates control signals for the dipper controls 343 such that the dipper 140 follows the ideal path.

In the full automation mode, the dump location data 1016 is provided by the hopper alignment system 395 to obtain the position of the dump location, or relative position between the dump location and dipper 140, without operator input. Once initiated, the dipper control signal module 1004 receives the ideal path from the ideal path generator module 1000 and generates control signals for the dipper controls 343 such that the dipper 140 follows the ideal path. Similar to the other modes, the ideal path generator module 1000 may continuously receive the current dipper data 1018, swing aggressiveness level 1020, and dump location data 1016 to continuously update the ideal path for use by the other modules of the controller 305.

In abnormal operation, the mode selector module 1008 receives an indication from the system information 1024 that faults are present that effect swing automation. The mode selector module 1008 determines if the faults prevent the user-selected swing automation mode from properly operating. If the faults prevent the user-selected swing automation modes from properly operating, the mode selector module 1008 will determine the next highest level mode of automation that is operational and output that mode as the selected mode to the boundary generator module 10002, dipper control signal module 1004, and feedback module 1006. For example, if the user has selected the full automation mode, but the system information 1024 indicates that the hopper communications system 390 is not able to provide a dump location to the ideal path generator module 1000, the mode selector module 1008 will automatically select the teach mode. Similarly, if in the motion restriction mode, teach mode, or full automation mode, and the system information 1024 indicates that the dipper control signals module 1004 is malfunctioning and cannot provide control signals to the dipper controls 343, the mode selector module 1008 will automatically select the trajectory feedback mode. Accordingly, in the presence of faults affecting the swing automation system, the mode selector module 1008 may override the user-selected swing automation mode.

In some embodiments, some or all of controller 305 functions and components, including the ideal path generation, are performed external to the rope shovel 100 and/or mobile mining crusher 175. For instance, the rope shovel 100 and/or mobile mining crusher 175 may output position data to a remote server that calculated an ideal path for the dipper 140 and returns the ideal path to the controller 305.

Thus, the invention provides, among other things, a swing automation system and method with various operation modes and combinations of operation modes.

What is claimed is:

1. A shovel including an automated swing system, the shovel comprising:

a dipper that is operable to dig and dump materials and that is positioned via operation of one or more motors; and a controller configured to receive operator controls related to controlling movement of the dipper using the one or more motors, receive dump location information indicating a desired position of the dipper corresponding to a dump location at which the dipper is to dump the materials, receive information indicating a performance limit of the one or more motors, receive dipper data related to at least one of a dipper position, a dipper movement, and a dipper state, the dipper data including a parameter of the one or more motors, calculate an ideal swing path of the dipper based on the dump location information and the at least one of the dipper position, the dipper movement, and the dipper state, calculate, based on the calculated ideal swing path and the performance limit, an ideal hoist path and an ideal crowd path, generate boundaries for the ideal hoist path and the ideal crowd path, and compare the dipper data to the boundaries, and when the dipper data indicates that the dipper is at or outside of the boundaries, adjust the operator controls to maintain the dipper within the boundaries.

2. The shovel of claim 1, wherein the one or more motors include one or more of a swing motor, a hoist motor, and a crowd motor.

3. The shovel of claim 1, wherein the controller is further configured to receive a swing aggressiveness level from an operator, wherein the ideal swing path is calculated based on the swing aggressiveness level.

4. The shovel of claim 1, wherein the dipper data further includes a current position of the one or more motors.

5. The shovel of claim 1, wherein the dump location information is received from one of global positioning satellite ("GPS") data and a memory storing a location of an previous operator-controlled dump.

6. The shovel of claim 1, wherein the controller is further configured to provide an operator with at least one of audio, visual, and tactile feedback of the dipper data relative to the dump location information.

7. The shovel of claim 1, wherein the boundaries are one of a ramp function, a constant window, and a polynomial curve.

8. The shovel of claim 1, wherein the controller is further configured to receive an operator mode selection that indicates one of at least three modes of swing automation, and control the shovel to operate in the selected swing automation mode.

9. The shovel of claim 8, wherein the at least three modes of operation include at least three of the following: no swing automation mode, trajectory feedback mode, teach mode, motion restriction mode, and full automation mode.

10. The shovel of claim 8, wherein the controller is further configured to receive system information indicating at least one equipment fault, and control the shovel to operate in a different swing automation mode based on the received system information.

11. The shovel of claim 1, wherein the controller is further configured to generate controls signals to control the one or more motors according to the ideal swing path, the ideal hoist path, and the ideal crowd path.

12. The shovel of claim 11, further comprising a hopper alignment system including at least one of a camera and a laser scanner, the hopper alignment system configured to determine when the dipper is within a predetermined range of the dump location, and control the dipper to align the dipper with the dump location.

13. A method of generating an ideal path for a shovel, the shovel including one or more motors and a dipper, the dipper operable to dig and dump materials, the dipper being positioned via operation of the one or more motors, the method comprising:

receiving operator controls related to controlling movement of the dipper using the one or more motors;

receiving dump location information indicating a desired position of the dipper corresponding to a dump location at which the dipper is to dump the materials;

receiving information indicating a performance limit of the one or more motors;

receiving dipper data related to at least one of a dipper position, a dipper movement, and a dipper state, the dipper data including a parameter of the one or more motors;

calculating an ideal swing path of the dipper based on the dump location information and the at least one of the dipper position, the dipper movement, and the dipper state;

calculating, based on the calculated ideal swing path and the performance limit, an ideal hoist path and an ideal crowd path;

generating boundaries for the ideal hoist path and the ideal crowd path; and comparing the dipper data to the boundaries, and when the dipper data indicates that the dipper is at or outside of the boundaries, adjust the operator controls to maintain the dipper within the boundaries.

14. The method of claim 13, further comprising receiving a swing aggressiveness level from an operator, wherein the ideal swing path is calculated based on the swing aggressiveness level.

15. The method of claim 13, wherein the dump location information is received from one of global positioning satellite ("GPS") data and a memory storing a location of an previous operator-controlled dump.

16. The method of claim 13, further comprising providing an operator with at least one of audio, visual, and tactile feedback of the dipper data relative to the dump location information.

17. The shovel of claim 16, further comprising illustrating the dump location information and dipper data.

18. The method of claim 13, wherein the boundaries are one of a ramp function, a constant window, and a polynomial curve.

19. The method of claim 13, further comprising receiving an operator mode selection that indicates one of at least three modes of swing automation, and controlling the shovel to operate in the selected swing automation mode.

20. The method of claim 19, wherein the at least three modes of operation include at least three of the following: no swing automation mode, trajectory feedback mode, teach mode, motion restriction mode, and full automation mode.

21. The method of claim 20, further comprising receiving system information indicating at least one equipment fault, and controlling the shovel to operate in a different swing automation mode based on the received system information.

22. The method of claim 13, further comprising generating controls signals to control the one or more motors based on the ideal swing path, the ideal hoist path, and the ideal crowd path.

* * * * *